US010208442B2

(12) United States Patent
Mast et al.

(10) Patent No.: US 10,208,442 B2
(45) Date of Patent: Feb. 19, 2019

(54) SNOW THROWER

(71) Applicant: Briggs & Stratton Corporation, Wauwatosa, WI (US)

(72) Inventors: James W. Mast, Sheboygan Falls, WI (US); Samuel J. Gerritts, Pewaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 15/451,388

(22) Filed: Mar. 6, 2017

(65) Prior Publication Data

US 2017/0175351 A1 Jun. 22, 2017

Related U.S. Application Data

(63) Continuation of application No. PCT/US2012/020083, filed on Jan. 3, 2012, and a continuation of application No. 14/540,574, filed on Nov. 13, 2014, now abandoned, which is a continuation of application No. PCT/US2013/040952, filed on May 14, 2013.

(60) Provisional application No. 61/647,056, filed on May 15, 2012.

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/04; E01H 5/045; E01H 5/098; E01H 5/06; E01H 5/065; E01H 5/10; E01H 5/106; E01H 5/108; E01H 5/1126; E01H 5/12
See application file for complete search history.

(56) References Cited

U.S. PATENT DOCUMENTS

| | | | | |
|---|---|---|---|---|
| 221,207 A | | 11/1879 | Avery | |
| 645,916 A | * | 3/1900 | Getler et al. | A01M 15/00 126/271.2 C |
| RE16,081 E | * | 5/1925 | Connolly | E01H 5/10 37/227 |
| 1,623,910 A | | 4/1927 | Curtis | |
| 1,629,160 A | * | 5/1927 | Heermance | E01H 5/10 126/271.1 |
| 1,701,787 A | | 2/1929 | Messlin | |
| 1,722,843 A | * | 7/1929 | Fasul | E01H 5/106 114/40 |
| 2,241,252 A | * | 5/1941 | Garland | E01H 5/076 37/236 |
| 2,278,220 A | | 3/1942 | Sicard | |
| 2,320,723 A | | 6/1943 | Gaylord | |

(Continued)

FOREIGN PATENT DOCUMENTS

JP 2004360379 12/2004

OTHER PUBLICATIONS

International Search Report for PCT/US2013/040952 dated Sep. 4, 2013.

*Primary Examiner* — Jamie L McGowan
(74) *Attorney, Agent, or Firm* — Rathe Lindenbaum LLP

(57) ABSTRACT

A snow thrower may include a housing, a rotatable snow moving member at least partially within the housing and a compressed gas knife coupled to the housing and aimed at an underlying terrain forward the housing.

19 Claims, 20 Drawing Sheets

(56) References Cited

U.S. PATENT DOCUMENTS

| | | | | | |
|---|---|---|---|---|---|
| 2,508,829 | A | | 5/1950 | Lamy | |
| 2,777,217 | A | | 1/1951 | Klauer | |
| 2,602,443 | A | * | 7/1952 | Leary | E01H 5/104 126/343.5 R |
| 3,044,753 | A | | 7/1962 | Wilcox, Jr. | |
| 3,106,792 | A | * | 10/1963 | Park | 126/343.5 R |
| 3,222,802 | A | | 12/1965 | Kiernan | |
| 3,303,588 | A | | 2/1967 | Krause | |
| 3,456,368 | A | | 7/1969 | Lucien | |
| 3,465,455 | A | | 9/1969 | Kiernan | |
| 3,583,084 | A | | 6/1971 | Farrell | |
| 3,805,766 | A | * | 4/1974 | Hammon | A01M 15/00 126/271.2 C |
| 3,878,804 | A | * | 4/1975 | Legerer | B63B 35/08 114/40 |
| 3,999,316 | A | | 12/1976 | Palmer | |
| 4,164,820 | A | | 8/1979 | Krickovich | |
| 4,477,988 | A | | 10/1984 | Vohl | |
| 4,869,003 | A | | 9/1989 | O'Loughlin | |
| 4,951,403 | A | | 8/1990 | Olmr | |
| 5,075,987 | A | * | 12/1991 | Akiyama | E01H 5/066 37/220 |
| 5,398,432 | A | | 3/1995 | Vohl | |
| 5,438,770 | A | * | 8/1995 | Miller | E01H 5/045 37/227 |
| 5,515,623 | A | | 5/1996 | Weeks | |
| 5,867,926 | A | | 2/1999 | Schmitt | |
| 5,953,892 | A | | 9/1999 | Albicker | |
| 5,966,847 | A | * | 10/1999 | Nathenson | B08B 5/02 137/874 |
| 6,058,688 | A | | 5/2000 | Krambeck | |
| 6,158,152 | A | * | 12/2000 | Nathenson | E02F 3/9206 239/532 |
| 6,327,798 | B1 | | 12/2001 | Sakai et al. | |
| 6,568,106 | B2 | | 5/2003 | Takeuchi | |
| 6,779,823 | B1 | * | 8/2004 | Fisher, Jr. | B60P 3/14 126/110 R |
| 6,865,826 | B1 | | 3/2005 | Lakin | |
| 7,137,214 | B2 | * | 11/2006 | Hoerle | E01H 10/007 239/663 |
| 8,191,289 | B2 | | 6/2012 | Raftery | |
| 8,696,244 | B2 | * | 4/2014 | Keylor | B09B 1/00 37/407 |
| 2002/0062582 | A1 | | 5/2002 | Takeuchi | |
| 2007/0089326 | A1 | | 4/2007 | Girouard | |
| 2008/0056820 | A1 | * | 3/2008 | Hall | E01C 19/176 404/75 |
| 2009/0013563 | A1 | | 1/2009 | Brown | |
| 2011/0314707 | A1 | | 12/2011 | Raftery | |
| 2012/0279093 | A1 | | 11/2012 | Niemela | |
| 2014/0130384 | A1 | | 5/2014 | Favorito | |
| 2015/0068074 | A1 | | 3/2015 | Mast | |
| 2015/0252544 | A1 | | 9/2015 | Houle | |

* cited by examiner

SNOW THROWER

CROSS-REFERENCE TO RELATED PATENT APPLICATIONS

The present application is a continuation application claiming priority under 35 USC Section 120 from co-pending application Ser. No. 14/540,574 filed on Nov. 13, 2014 by Mast et al and entitled SNOW THROWER, which claims priority from PCT/US13/40952 filed on May 14, 2013 and entitled SNOW THROWER AND ACCESSORIES by Samuel J. Gerritts et al., the full disclosures both of which is hereby incorporated by reference. Application number PCT/US13/40952 claims priority to U.S. Provisional Application Ser. No. 61/647,056 filed on May 15, 2012 by Samuel J. Gerritts et al. and entitled SNOW THROWER AND ACCESSORIES, the full disclosure of which is hereby incorporated by reference.

BACKGROUND

Single-stage snow throwers utilize a single impeller to both cut through snow and discharge the snow through a chute. Existing single-stage snow throwers experience difficulties with large amounts of snow or hardened snow. Two-stage snow throwers cut the snow in a first stage with an auger and transfer the snow to an impeller which discharges the snow through the chute in a second stage. Existing two-stage snow throwers may not adequately handle deep snow, may not adequately clean hardened snow from the underlying terrain, may utilize complex and expensive transmissions and may be difficult to operate.

DETAILED DESCRIPTION OF THE EXAMPLE EMBODIMENTS

Figure 1:
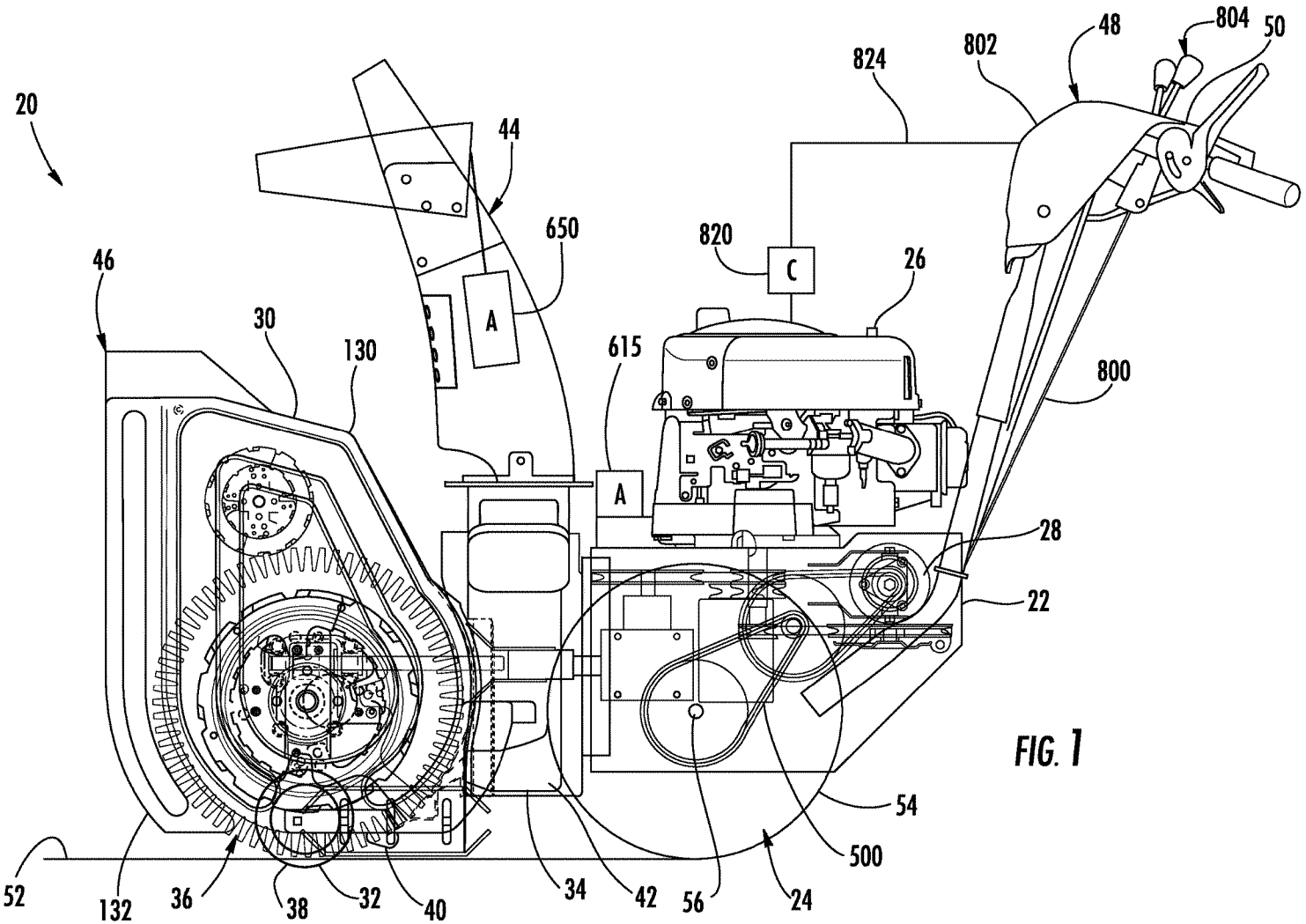
FIG. 1 is a side view of an example snow thrower with portions transparently shown.

FIG. 1 is a side elevational view of an example snow thrower 20. Snow thrower 20 provides a person with the opportunity to clear snow in an easier and more cost-effective manner. Snow thrower 20 generally comprises a frame 22, traction members 24, vertical shaft engine 26, transmission 28, adjustable auger housing system 30, housing support disc systems 32, impeller housing 34, auger system 36, sweeping system 38, cutting system 40, impeller 42, chute assembly 44, lighting system 46, handle arrangement 48 and control system 50.

Frame 22 comprises one or more brackets, plates, bars, frames or other structures which support remaining components of snow thrower 20. Traction members 24 comprise members movably supported in engagement with the underlying terrain 52 which are configured to engage in provide traction for movement along terrain 52. For purposes of this disclosure, the phrase "configured to" denotes an actual state of configuration that fundamentally ties the stated function/use to the physical characteristics of the feature proceeding the phrase "configured to". In the example illustrated, traction members 24 comprise wheels 54 rotatable about a traction axis 56. In one implementation, traction members 24 are rotationally driven by engine 26. In other implementations, traction members 24 may be manually pushed. In other implementations, traction members 24 may comprise wheels that drive endless tracks or other terrain engaging members.

Figure 2:
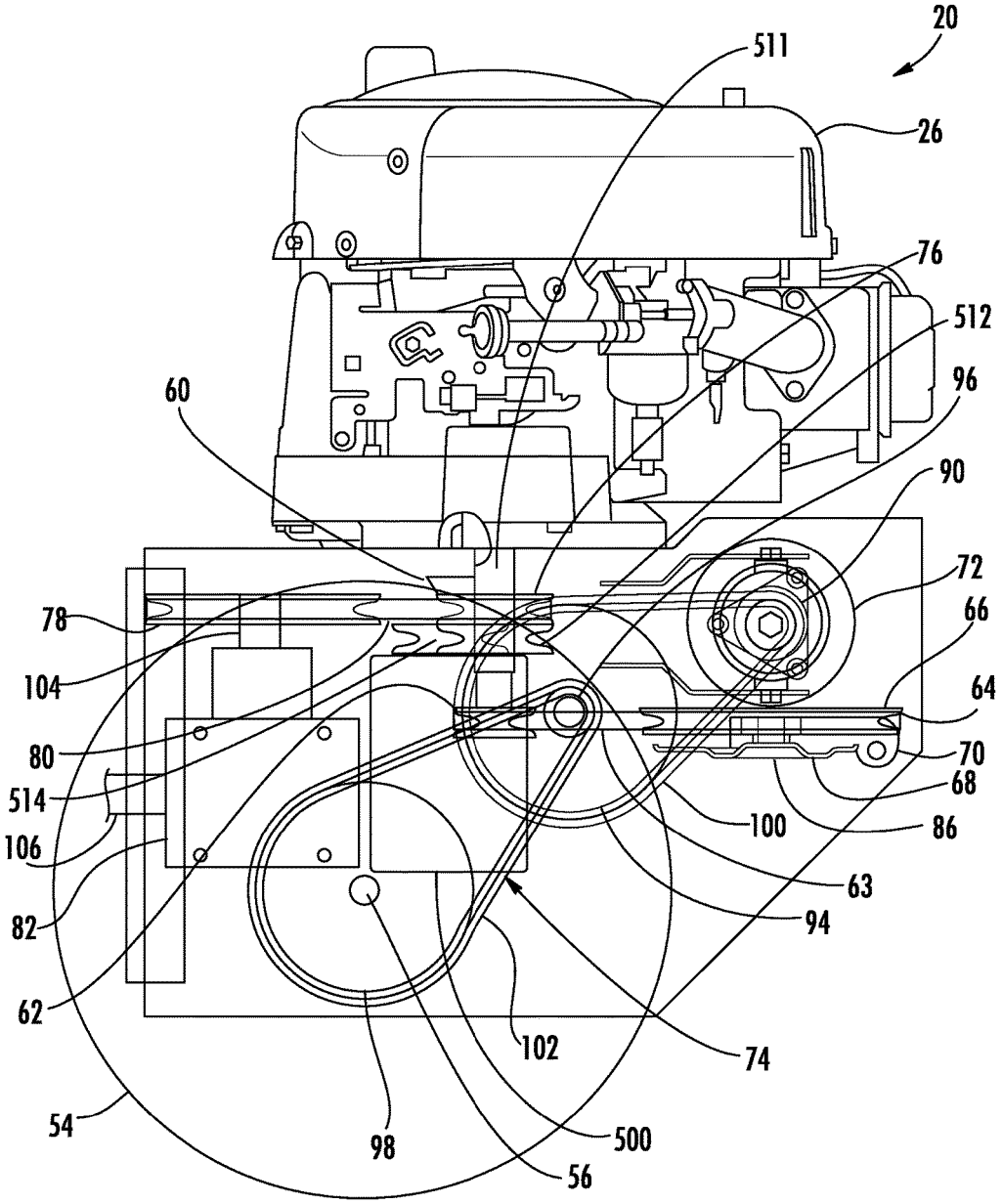
FIG. 2 is a side view of an example transmission of the snow thrower of FIG. 1 with portions transparently shown.

Vertical shaft engine 26 comprises a vertical shaft engine supported by frame 22 and operably coupled to traction members 24 by traction or friction drive 28. Transmission 28 receives torque from a vertical output shaft 60 from engine 26 and transmits such torque to drive traction members 54 as well as auger system 36. FIG. 2 is an enlarged view illustrating transmission 28. As shown by FIG. 2, transmission 28 comprises pulley 62, belt 63, pulley 64, friction plate or disc 66, support 68, bias 70, friction wheel 72, speed reducer 74, pulley 76, pulley 78, belt 80 and right angle gear drive 82. Pulley 62 is operably coupled to vertical output shaft 60 of engine 26 and drives belt 63 which wraps about pulley 64. Pulley 64 is fixed to friction disk or plate 66 to rotationally drive the friction disk or plate 66 about vertical axis 86 which is rotationally supported by support 68. In some implementations, plate 66 may be provided as part of pulley 64. Support 68 pivots about axis horizontal axis 70 to move friction plate 66 between an engaged position in engagement with friction wheel 72 and a retracted or withdrawn position out of engagement with friction wheel 72. Support 68 supports plate 66 below friction wheel 72 while bias 70 resiliently biases support 68 and plate 66 upward towards the engaged position. In the example illustrated, bias 70 comprises a torsion spring.

In other implementations, bias 70 may comprise other springs for resiliently biasing support 68 and plate 66 about a horizontal pivot axis. In some implementations, bias 70 may be omitted, wherein belt 63 solely supports plate 66 in the engaged position. In yet other implementations, friction plate 66 may be vertically movable upward into engagement with wheel 72 or vertically movable downward out of engagement with wheel 72 in other fashions other than through pivotal movement.

Friction wheel 72 comprises a wheel having an outer circumferential edge of frictional contact in engagement with friction plate 66 when friction plate 66 is rotationally supported in the engaged position by support 68. Friction wheel 72 engages friction plate 66 at one or more locations eccentric to the rotational axis 86 of plate 66. Friction wheel 72 receives and transmits torque from friction plate 66 to speed reducer 74.

Friction wheel 72 and friction plate 66 cooperate to form a friction drive. In the example implementation illustrated, the friction drive formed by the interaction or friction joint between plate 66 and wheel 72 is located rearward of traction axis 56 and nominally rearward of the vertical shaft of engine 26. In the example implementation illustrated, the friction drive is additionally located vertically above traction axis 56. As a result of its location, the friction drive provided by friction wheel 72 and friction plate 66 is distant impeller housing 34 and chute assembly 44. Rather than being located proximate to impeller housing 34 and chute assembly 44, the friction drive is substantially isolated from the introduction of moisture by snow and ice or other the introduction of other contaminates. As a result, a dry clean environment for the friction drive is facilitated with a reduced reliance upon complex and costly moisture sealing structures, such as rubber gaskets and the like.

Because friction plate 66 moves or swings wings upwardly into engagement with friction wheel 72, in cases a failure, such as failure of belt 63, support 68 may fall under the force of gravity against the bias to reposition friction plate 66 out of frictional contact with wheel 72. As a result, this arrangement facilitates an enhanced automatic disengagement of the drive driving traction members 54 in response to belt or other failures. In other arrangements, friction plate 66 may alternatively be located above friction wheel 72.

Speed reducer 74 transmits torque from friction wheel 72 to an axle of traction members 54 about traction axis 56 while reducing the speed of such rotational motion. In the example illustrated, speed reducer 74 comprises a set of speed reducing pulleys and belts, pulleys 90, 94, 96, 98 and belts 100, 102. In other implementations, sprocket and chain arrangements or gear trains may alternatively be utilized for speed reducer 74 or in place of and the other arrangements wherein belt and pulleys are disclosed.

Pulley 76, 78, belt 80 and right angle gear box 82 cooperate to transmit torque from output shaft 60 to other implements, such as auger system 36 and impeller 42. Pulley 76 is operably coupled to output shaft 60 and is connected to pulley 78 by belt 80. Pulley 78 is fixed to an input shaft 104 of right angle gear box 82. Right angle gear box 82 comprises series of gears whereby torque about a vertical axis is converted to torque about a horizontal axis, such as through the use of a pair of bevel gears (not shown). Torque from right angle gear box 82 is discharged through a horizontal output shaft 106 which is operably coupled to auger system 36 and impeller 42.

Figure 3:
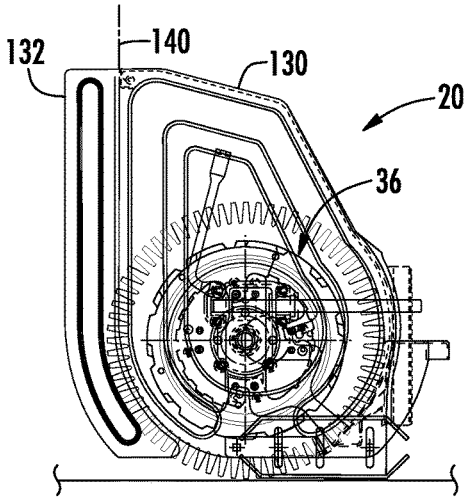
FIG. 3 is a side view of an example adjustable auger housing of the snow thrower of FIG. 1 with portions transparently shown.
Figure 4:
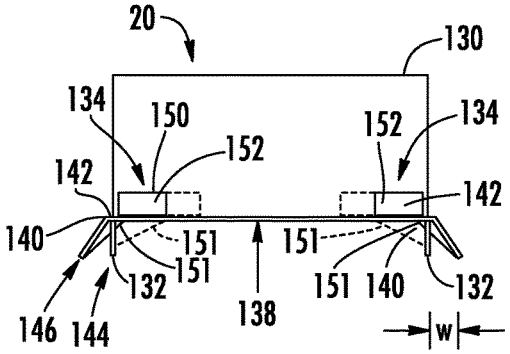
FIG. 4 is a top plan schematic view of the adjustable auger housing of FIG. 3.
Figure 5:
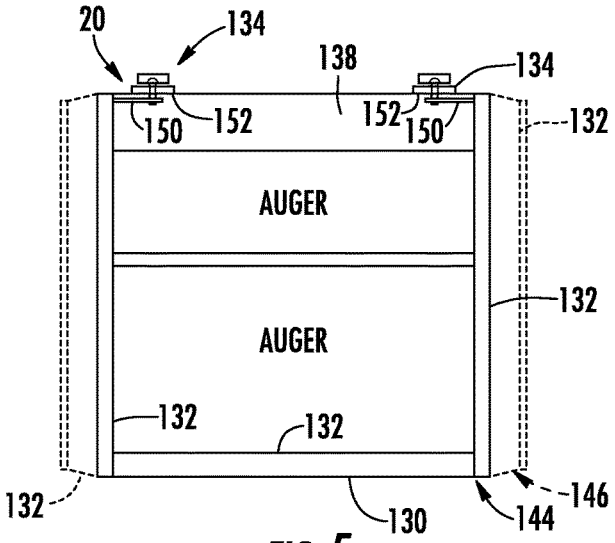
FIG. 5 is a front view of the adjustable auger housing of FIG. 4.

FIGS. 3-5 illustrate adjustable auger housing system 30. Adjustable auger housing system 30 houses auger system 36 and direct snow to auger system 36. Adjustable auger housing system 30 comprises a main housing 130, wings or extensions 132 and retainers 134. Main housing 130 partially enclose and extends about at least one rotatable snow moving member, such as an auger as with a two-stage or three stage snow thrower or an auger/impeller as with a one stage snow thrower. In the example illustrated, main housing 130 houses auger system 36, part of a 2+ stage snow thrower. Auger housing 130 directs snow to auger system 36 which move such snow to impeller 42. In one implementation, auger housing 130 comprises a single integral structure integrally formed as a single unitary body of a single sheet or layer of material that is deformed or deep drawn. In other implementations, auger housing 130 may be formed from multiple structures which are welded, fastened or otherwise joined to one another.

Wings or extensions 132 comprise elongate flaps or panels pivotably coupled to main auger housing 130 on opposite sides of a mouth 138 of housing 130 for pivotal movement about axes 140 defined by hinges 142. As shown by FIGS. 4 and 5, extensions 132 pivot between a first narrow position 144 shown in solid lines and a second extended or mouth widening position 146 shown in broken lines. In the mouth widening position 146, extensions 132 and large the size of mouth 138 to capture and direct a greater width of snow. In one implementation, the mouth widening position 146 increases a width W on each side by at least 1 inch and nominally 2 inches, enabling the entire with of mouth 138 to be increased by at least 2 inches and nominally 4 inches. At the same time, repositioning of extensions 132 to the narrow position 144 decreases the width of mouth 138 when it is desirable to reduce a rate at which snow is captured and directed to auger's, such as when the snow is deeper or heavy (wet). Reposition extension 132 to the narrow position 144 further reduces the width of mouth 138 and auger housing 30 for reduced consumption of space when in storage. In the example illustrated, pivotal movement of extensions 132 is independent; one extension 132 may be extended while the other extension 132 is retracted.

Retainers 134 secure and retain extensions 132 and at least either of positions 144, 146. In one implementation, retainers 134 are configured to secure and retain extensions 132 and any of continuum of intermediate locations or positions between positions 144, 146. In the example implementation shown in FIGS. 4 and 5, each retainer 134 comprises retaining plate 150, links 151 and retaining pin 152. Retaining plate 150 comprise a plate slidably supported along housing 130 by grooves, tracks or other guiding structures for movement between a first position shown in solid lines and a second extended position shown in broken lines. Links 151 comprise members pivotally connected at one end to extension 132 and at another end to plate 150 such that movement of extension 132 from the extended position 146 to the narrow position 144 slides plate 150 from the first position to the second extended position and vice versa.

Retaining pin 152 of each actuator 134 comprises a pin movable between a plate engaging position in which pin 162 engages plate 152 inhibit movement of plate 150 and a withdrawn position or disengaged position allowing plate 152 be moved. In one implementation, pin 152 comprises a threaded shaft or pin threadably engaging a threaded bore, allowing pin 152 to be rotated between engaging position in the disengaged position. In another implementation, pin 152 may be resiliently biased by spring towards the engaging position, allowing a person to pull pin 152 against the bias to the withdrawn or disengaged position. In one implementation, pin 152 has an axial end which frictionally engages a face of plate 150. In another implementation, pin 152 projects partially into a depression or detent in plate 150. In yet another implementation, the detent comprises a hole or opening extending completely through plate 150, wherein pin 152 projects through the hole when in the engaged position.

In still other implementations, other retaining mechanisms may be used to selectively retain each extension 132 in either the narrow or mouth widening positions. For example, in other implementations, a powered actuator may be used to selectively move extension 132 between positions 144, 146 and to selectively retain extensions 132 between the positions 144, 146. In one implementation, an electric solenoid may have a first end pivotally connected to housing 130 and a second end pivotally connected to an extension 132 to selectively move and retain the extension 132. In another implementation, a hydraulic or pneumatic piston-cylinder assembly may have a first and pivotally connected to housing 130 and a second end pivotally connected to an extension 132 to selectively move and retain the extension 132. In yet another implementation, such actuation and retention may be provided by a motor that rotatably drives a worm screw or threaded rod pivotably attached to extension 132 to pivot extension 132.

Figure 6:
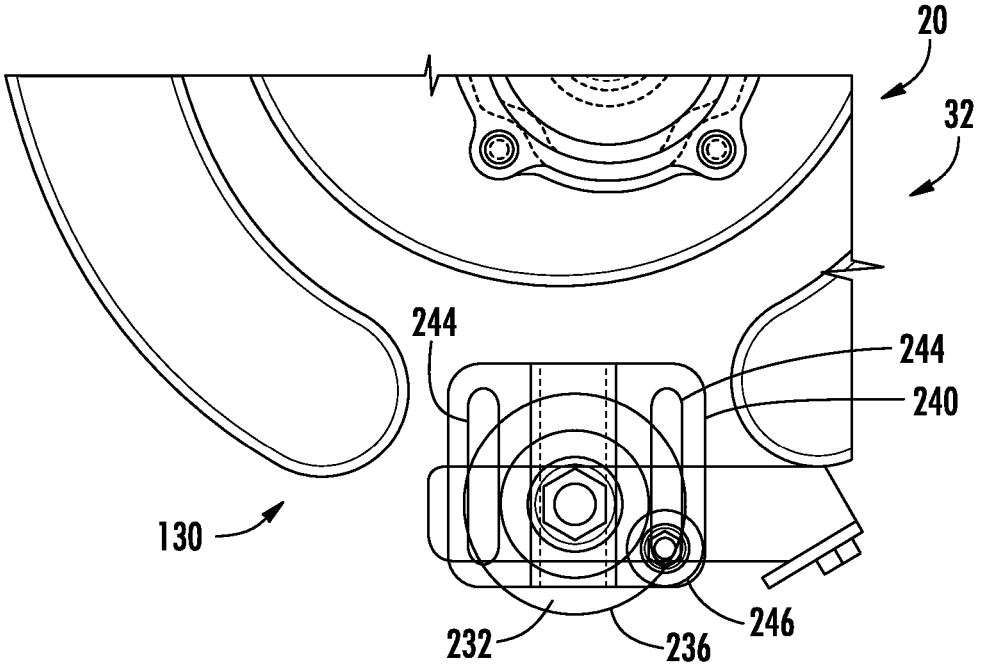
FIG. 6 is a side view of an example housing support disc system of the snow thrower of FIG. 1 with portions transparently shown.
Figure 7:
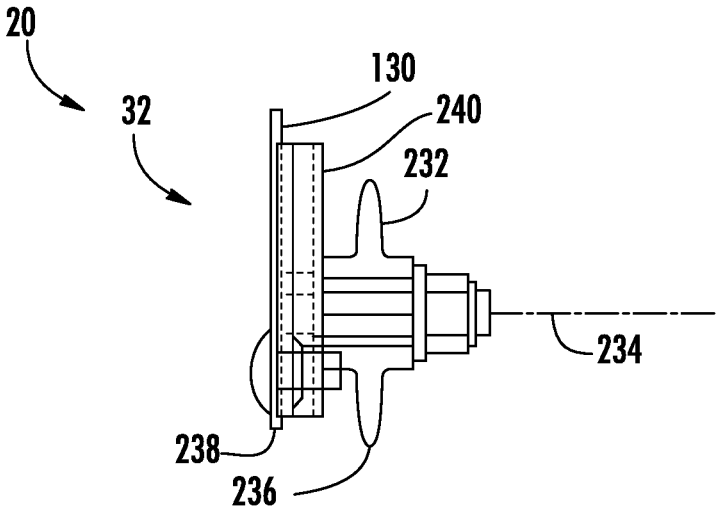
FIG. 7 is a fragmentary front view of the housing support disc system of FIG. 6 with portions transparently shown.

FIGS. 6 and 7 illustrate one of housing support disc systems 32 in more detail. An example illustrated, snow thrower 20 includes two housing support disc systems 32, one on each side. In other implementations, snow thrower 20 may include more than one housing support disc systems 32 on each side. As shown by FIGS. 6 and 7, each of housing support disc systems 32 comprises a rotatable disc 232 rotationally coupled to housing 130 for rotation about axis 234. Disc 232 has an outer circumference 236 thinning below or lower than a bottom 238 of housing 130. Disc 232 is configured to at least partially cut through or slice through packed snow, allowing snow thrower 20 to better remove packed snow and to inhibit housing 130 from undesirably riding up on such packed snow. At the same time, disc 232 rotates to reduce resistance to forward movement of snow thrower 20.

In one implementation, disc 232 has at least an outer circumferential edge 236 that is sufficiently soft so as to not score underlying concrete or pavement. For example, in one implementation, disc 232 has an outer circumferential edge 236 having a polymeric surface. In one implementation, edge is formed from a high density polyethylene. In yet other implementations, an entirety of disc 232 may be formed from such a polymeric material, such as a high density polyethylene. In yet other embodiments, disc 232 may be formed from other materials or may have different degrees of sharpness to cut through packed snow while avoiding scoring of underlying pavement or concrete.

In one implementation, disc 232 has a thickness of less than or equal to 0.5 inches along the outer circumferential edge 236. In one implementation, disc 232 has a uniform radial thickness. In another implementation, disc 232 tapers towards circumferential edge 236 to better facilitate cutting through packed snow. In yet other implementations, disc 232 may include multiple parallel blades or discs or may have other configurations.

In one implementation, each disc 232 is supported at an adjustable height with respect to a bottom 238 of housing 130. In other words, each disc 232 is adjustable to one of a plurality of available positions. In the implementation shown in FIG. 6, disc 232 is rotatably supported and carried by a support bracket 240 which is itself movably coupled the housing 130. In the example illustrated, support bracket 240 includes a pair of spaced slots 244 with a fastener 246 (a bolt) extending through each slot and a return 44 (one of which is shown) and through a corresponding opening within housing 130, wherein a not secures the bolt in place to retain support bracket 240 and a selected position with respect to housing 130 to support disc 232 at a selected height with respect to housing 130. In other implementations, support bracket 244 may be selectively secured at different positions with respect to housing 130 by other fasteners and other adjustable mounting mechanisms. In still other implementations, disc 232 may be directly secured to housing 130 in a manner to allow adjustable repositioning. For example, disc 232 may include a bolt which selectively positioned within an elongate slot formed within housing 130 and held in place by an associated nut.

Figure 8:
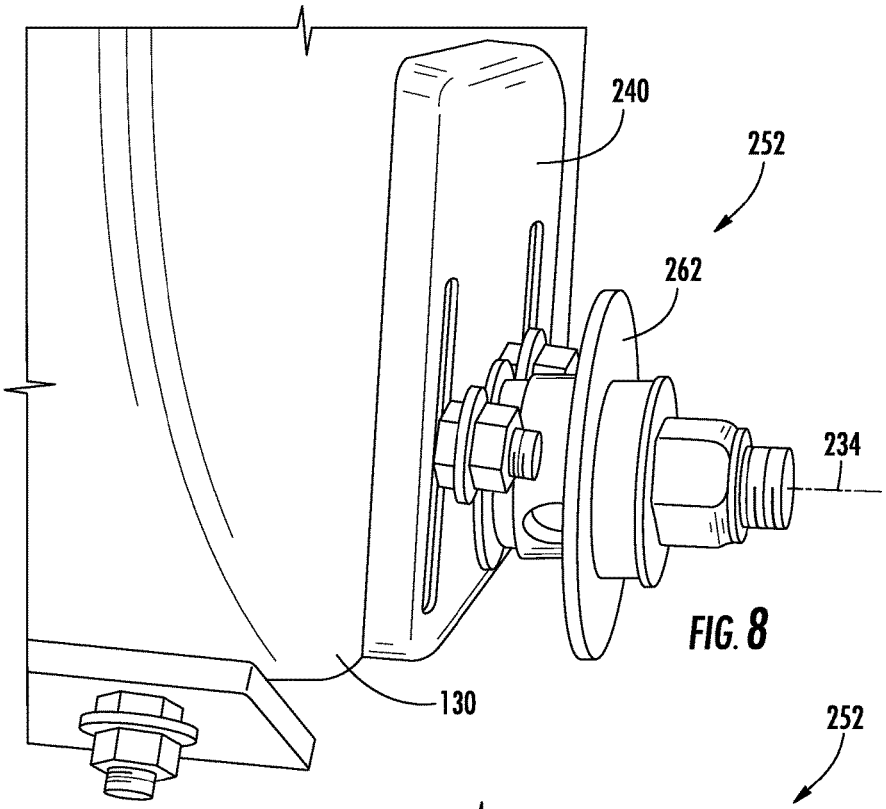
FIG. 8 is a front perspective view of an example implementation of the housing support disc system of FIG. 6.
Figure 9:
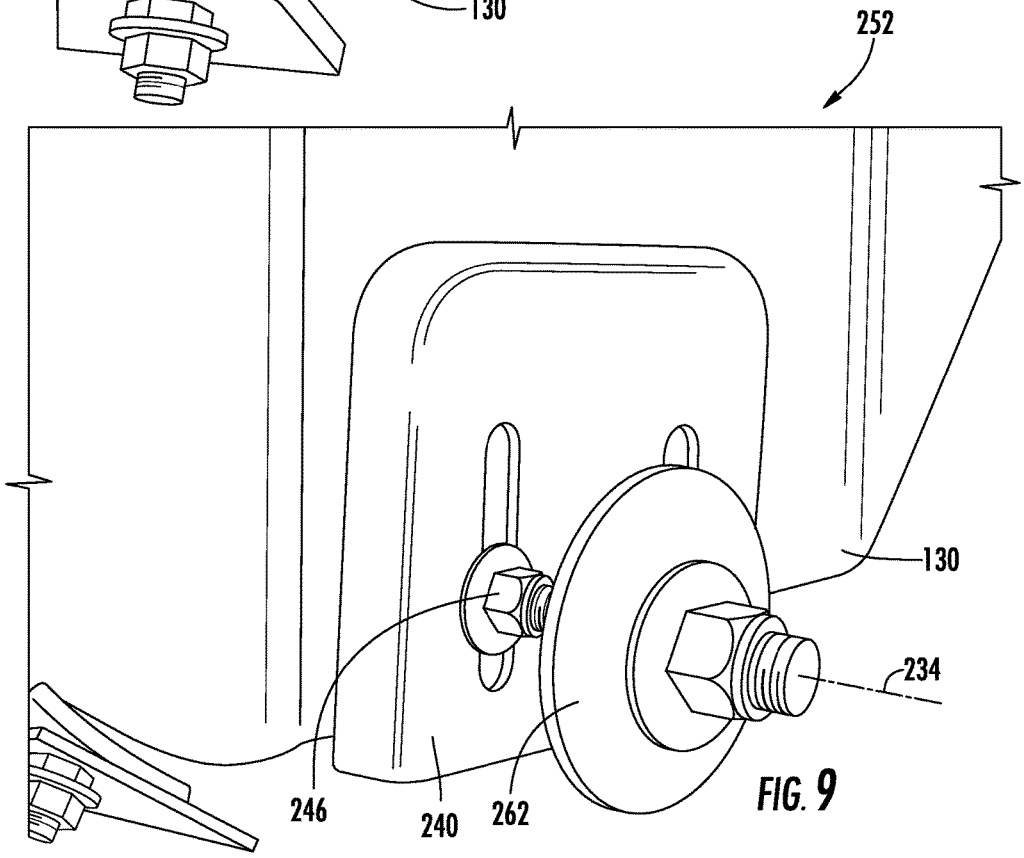
FIG. 9 is another front perspective view of the housing support disc system of FIG. 8.

FIGS. 8 and 9 illustrate housing support disc system 252, a particular example implementation of housing support disc system 32. Housing support discs system is similar to housing support discs system 32 except that housing support discs system 252 includes housing support disc 262 in place of disc 232. In the example illustrated, disc 262 comprises a washer rotatably supported by bracket or support 240 at one of a plurality of different positions with respect to housing 130. In other implementations, housing support discs system 252 may have other configurations.

As shown by FIG. 1, impeller housing 34 comprises a cylindrical structure, sometimes referred to as an impeller can, connected to a rear of auger housing 30 for receiving snow from auger assembly 36. Impeller housing 34 surrounds and encloses impeller 42 and includes an outer opening through which snow is directed by impeller 42 into and through chute assembly 44.

Figure 10:
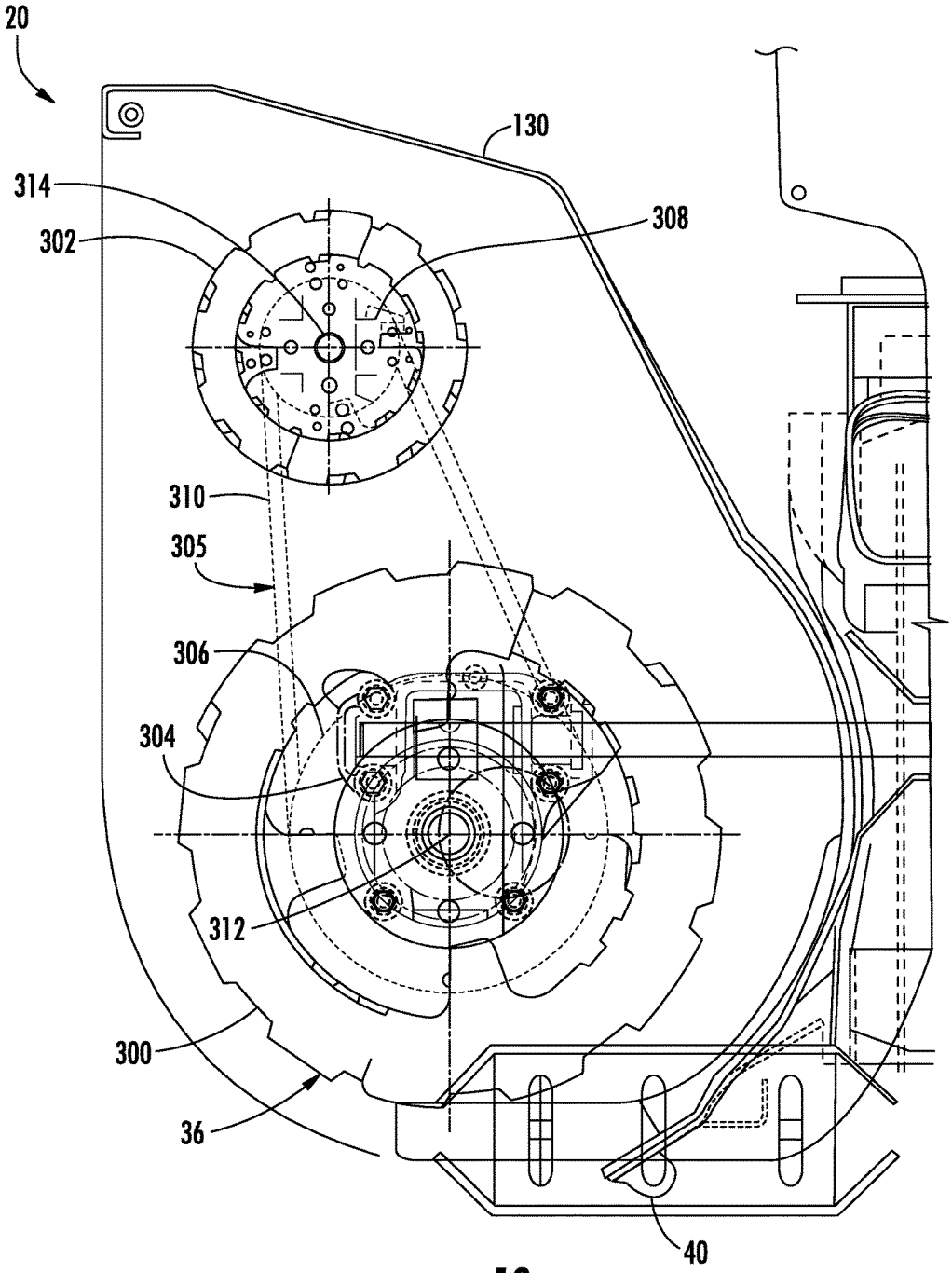
FIG. 10 is a side view of an example auger system of the snow thrower of FIG. 1 with portions transparently shown.

Auger assembly or system 36 comprises an arrangement of one or more augers to break apart snow and direct such snow into impeller housing 34 for further impelling by impeller 42. In the example illustrated, auger assembly 36 provides for two levels of snow collection and breakup. As best shown by FIG. 10, auger system 36 is largely contained within auger housing 130 and comprises a main auger 300, auxiliary auger 302, auger gearbox 304, and auxiliary auger drive 305 (schematically shown in FIG. 11) provided by pulleys 306, 308 and belt 310. Main auger 300 comprises a helical blade or series of blades rotatable about axis 312 so as to breakup snow and direct such snow towards a central opening where it may flow into impeller can or impeller housing 34.

Figure 11:
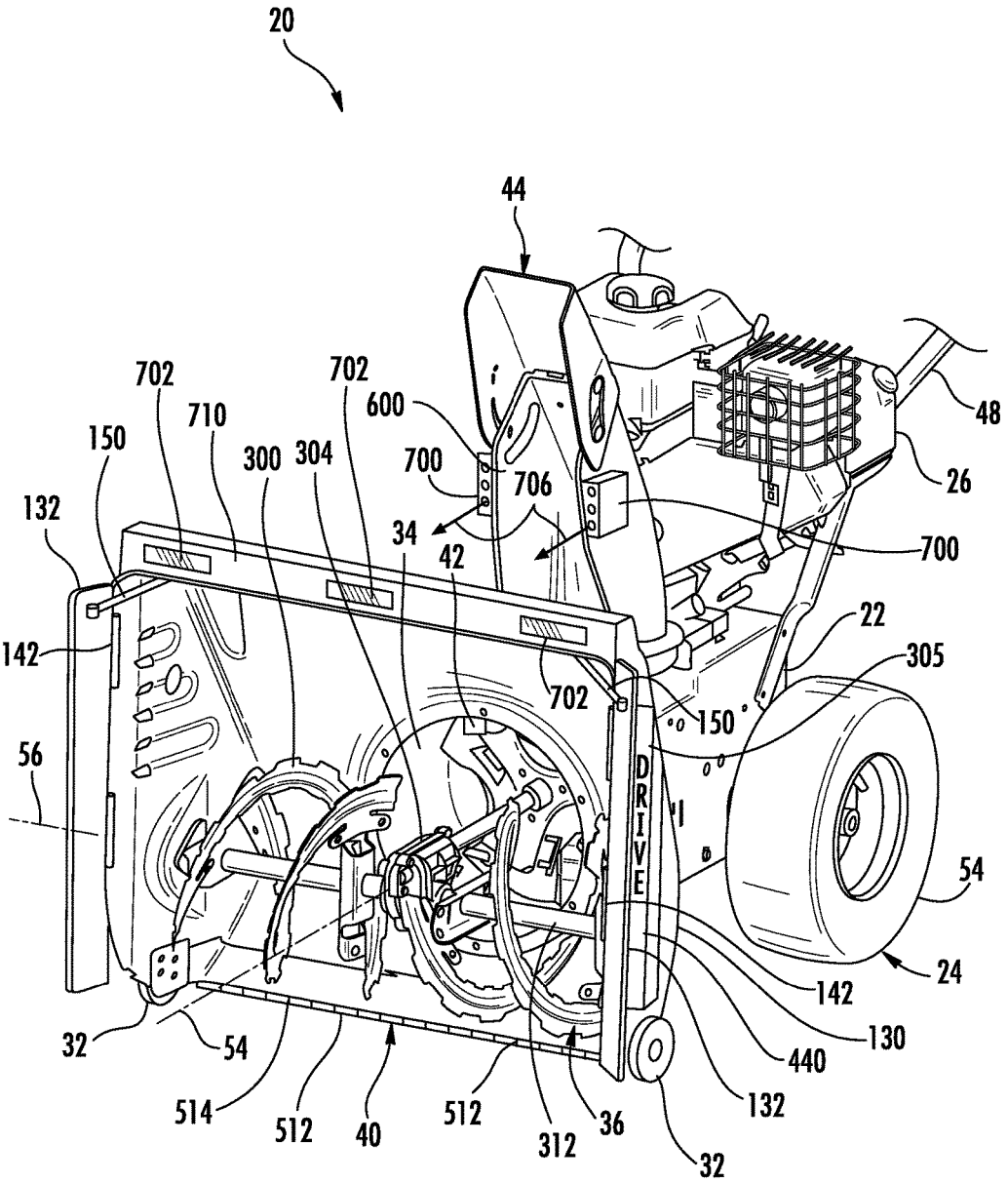
FIG. 11 is a front perspective view of the snow thrower of FIG. 1.

FIG. 11 is a front perspective view of snow thrower 20, with some portions omitted to better illustrate other portions of snow thrower 20. FIG. 11 illustrates auger system 36 with auxiliary auger 302 and the auxiliary auger drive provided by pulleys 306, 308 and belt 310 being omitted. As shown by FIG. 11, the lower main auger 300 comprises multiple helical flights mounted to form a composite helical auger blade. In other implementations, floor main auger 300 and be formed as a single blade or may have other configurations.

In the example illustrated, main auger 300 has an outer diameter that is less than an outer diameter of impeller 42. In one implementation, auger 300 has a diameter of less than or equal to 12 inches. Because main auger 300 has an outer diameter that is less than the outer diameter of impeller 42, main auger housing 130 may be shallower, facilitating the formation of auger housing 130 from a single deep drawn sheet of material while at the same time maintaining the diameter of impeller 42 to maintain the snow throwing distance of snow thrower 20.

As shown by FIG. 10, auxiliary auger 302 comprises one or more structures forming one or more helical blades that are rotatably supported by housing 130 above main auger 300. Auxiliary auger 302 rates of snow above the lower main auger 300. Like main auger 300, auxiliary auger 302 channels snow towards the center of housing 130 and into impeller housing 34. As a result, augers 300, 302 facilitate more efficient movement of deep snow.

In the example illustrated, auxiliary auger 302 has a diameter smaller than the diameter of auger 300. In other implementations, auger 302 may have a diameter the same are larger than the diameter of auger 300. In the example illustrated, auger 302 rotates in the same direction as auger 300, clockwise as seen in FIG. 10. In other implementations, auger 302 may rotate in opposite direction as compared to auger 300, in a counter clockwise direction as seen in FIG. 10. In yet other implementations, auxiliary auger 302 and its drive may be omitted.

Auxiliary auger drive 305, provided by pulleys 306, 308 and belt 310, transmits torque from horizontal shaft driving main auger 300 to the horizontal shaft supporting auxiliary auger 302 to drive auxiliary auger 302. In the example illustrated, torque is transmitted to main auger 300 by auger gearbox 304 located at a center point of main auger 300. Pulley 306 is fixed to a center shaft 312 of main auger 300 outside of auger housing 130 along a side of auger housing 130 to rotate with shaft 312. Pulley 308 is fixed to a center shaft or drive shaft 314 of auxiliary auger 302 outside of auger housing 130 along the same side of auger housing 130 as pulley 306. Belt 310 wraps about pulleys 306, 3082 transmits torque along the outside of auger housing 130 from shaft 312 to shaft 314. Because auxiliary auger drive 305 transmits torque auxiliary auger 302, separate torque sources for auxiliary auger 302 may be omitted. Because drive 305 extends along in outside of auger housing 130, the capacity of auger housing 130 is not reduced and drive 305 is at least partially isolated from the moisture and driving forces of the snow.

In other implementations, separate sources of torque, independent of main auger 300, may be provided for auxiliary auger 302. In other implementations, other mechanisms may be utilized to transmit torque from main auger 300 to auxiliary auger 302. For example, gear trains or chain and sprocket assemblies may also be utilized for transmitting torque. Although illustrated as being along an outside surface of housing 130 (contained in a shield or box), in other implementations, drive 305 may be located within a box located along an interior of housing 130.

Figure 12:
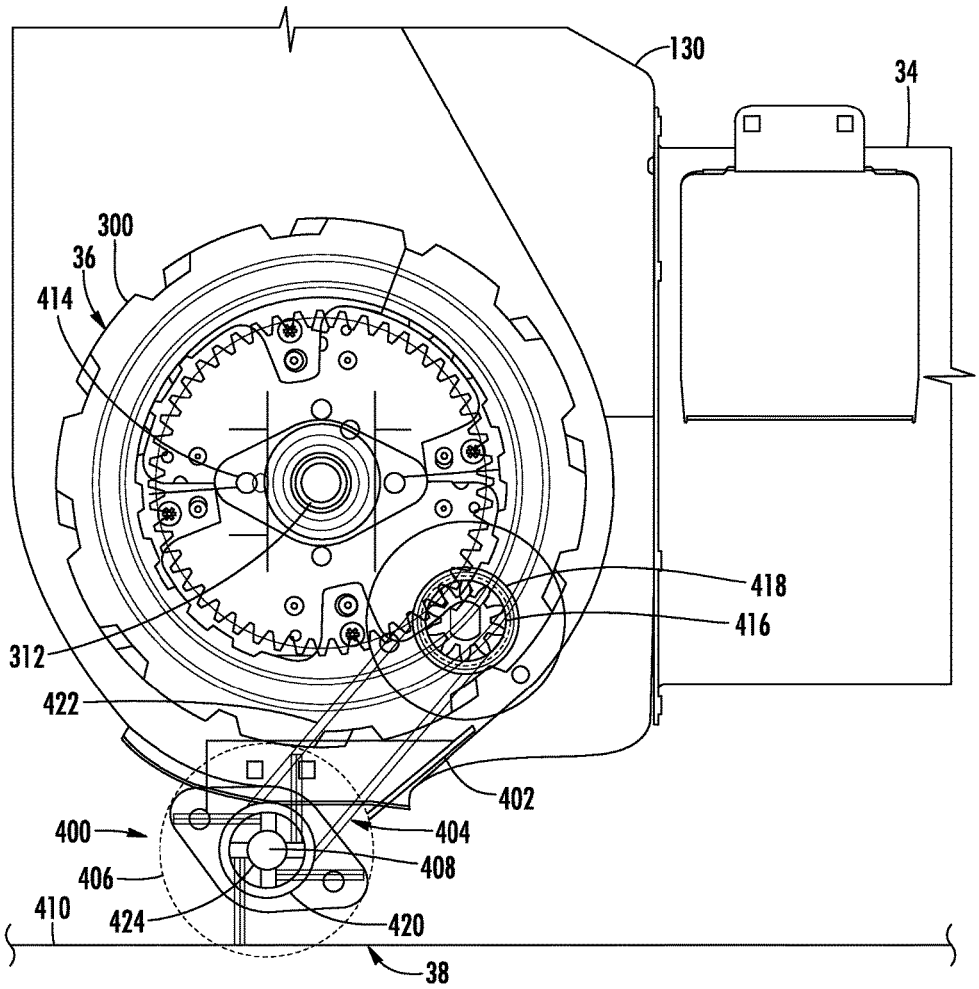
FIG. 12 is a side view of an example sweeper system of the snow thrower of FIG. 1 with portions transparently shown.

Sweeping system 38 comprises a mechanism configured to provide a resiliently flexible support at a front end the snow thrower 20 for engaging the terrain while resiliently adapting to minor changes in the terrain (cracks, groups, ridges and the like) and for cleaning snow down to the terrain surface. As shown by FIG. 12, sweeping system 38 comprises sweeper 400, scraper bar 402 and sweeper drive 404. Sweeper 400 comprises a member which rotates about axis 408 below the rotational axis of main auger 300. Sweeper 400 has resiliently bendable, flexible or deformable extensions 406 that radially extend away from the rotational axis 408 of sweeper 400 into engagement with the underlying terrain. Such extensions 406 scrape or brush against the underlying terrain 410 to support auger housing 130 above the terrain. Such extensions resiliently flex or deform when encountering irregularities in terrain 410, such as cracks, bumps, ridges and the like to conform to such irregularities for removing snow from against such irregularities while also reducing sharp jolts which might otherwise occur when auger housing 130 would otherwise bump into such irregularities. In one implementation, such extensions 406 comprise tines or bristles. In another implementation, extensions 406 comprise flexible or deformable paddles.

Scraper bar 402 comprises a blade, edge or panel adjacent sweeper 400 rearward of the rotational axis 408 of sweeper 400. Scraper bar 402 engages sweeper 400 proximate to an outer circumferential perimeter of sweeper 400. Scraper bar 402 removes snow from sweeper 400 and directs such snow into auger housing 130. Scraper bar 402 inhibits recirculation the snow back to terrain 410. In other implementations, scraper bar 402 may be omitted.

Sweeper drive 404 rotationally drives sweeper 400 about axis 408. In the example illustrated, drive 404 rotates sweeper 400 in a clockwise direction while main auger 300 is driven in a counter clockwise direction. Sweeper drive 404 comprises auger driven gear 414, driven gear 416, pulley 418, pulley 420 and belt 422. Auger driven gear 414 comprises a gear fixed to center shaft 312 of auger 300 to rotate with the rotation of center shaft 312.

Driven gear 416 comprise a gear rotationally supported by housing 130 in meshing engagement with gear 414. Driven gear 416 is fixed to pulley 418 so as to rotate pulley 418. Pulley 420 is fixed to a center shaft 424 of sweeper 400. Belt 22 wraps about and connects pulleys 418 and 420. As a result, rotation of auger 300 also rotates sweeper 400.

In other implementations, separate drives and separate sources of torque may be provided for sweeper 400. In other implementations, sweeper 400 may not be driven. In other implementations, other mechanisms may be utilized to transmit torque from auger 300 to sweeper 400. For example, a chain and sprocket arrangement or a gear train may alternatively be utilized.

Figure 15:
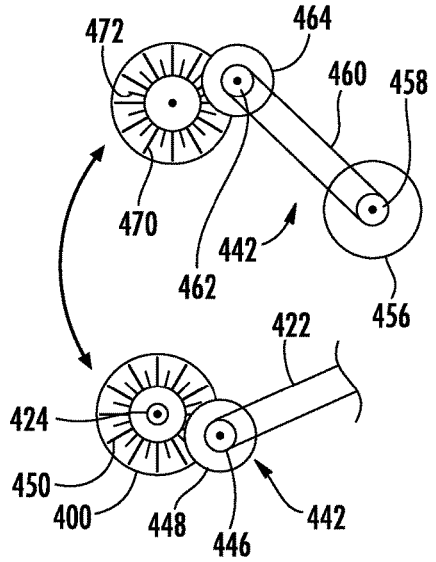
FIG. 15 is a side view of another example sweeper of the sweeper system of FIG. 13, illustrating movement of a sweeper between raised and lowered positions.
Figure 13:
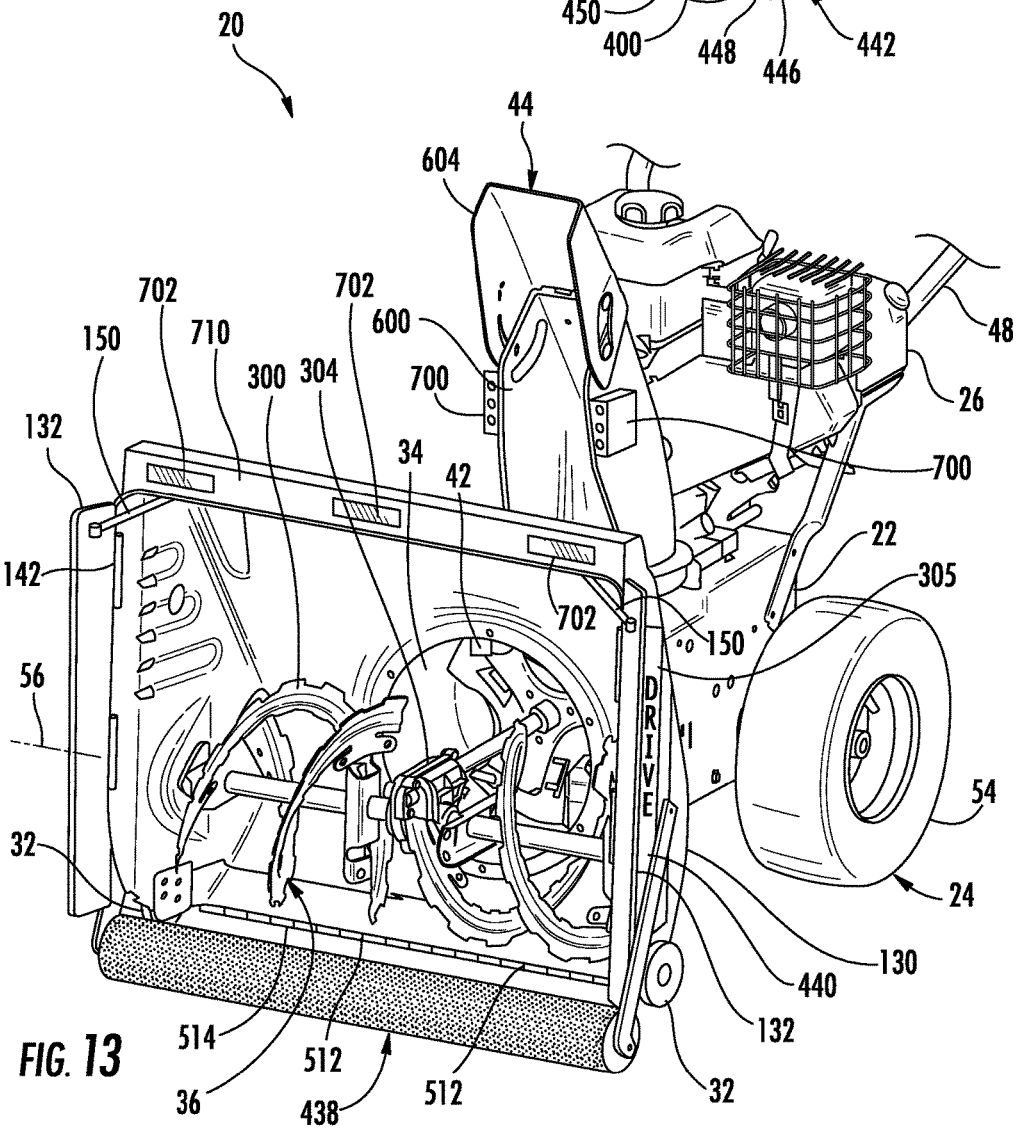
FIG. 13 is a front perspective view of the snow thrower a FIG. 1 including another example sweeper system in a lowered state.
Figure 14:
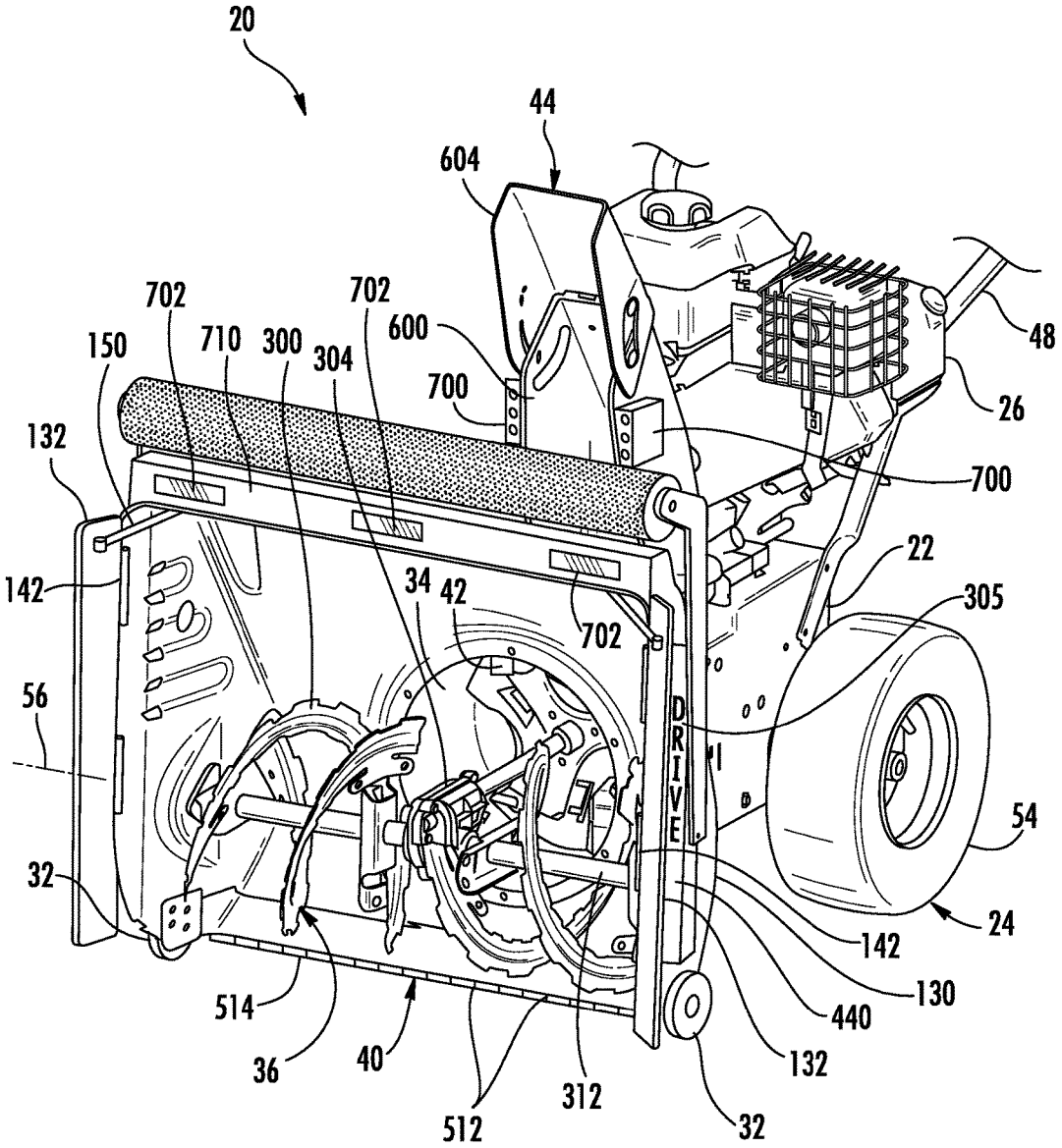
FIG. 14 is a front perspective view of the snow thrower of FIG. 12 with the sweeper system in a raised state.

FIGS. 13-15 illustrate snow thrower 20 having an alternative sweeper system 438. Like sweeper system 38, sweeper system 438 includes a sweeper 400 that provides a resiliently flexible support at a front end the snow thrower 20 for engaging the terrain while resiliently adapting to minor changes or irregularities in the terrain (cracks, grooves, ridges and the like) and for cleaning snow down to the terrain surface. In addition, sweeper 400 of sweeper system 438 is actuatable between a lowered state or position shown in FIG. 13 and a raised state or position shown in FIG. 14.

In addition to sweeper 400, sweeper system 438 comprises swing arms 440 and sweeper drive 442 (shown in FIG. 15). Swing arms 440 comprise arms having a first end pivotally coupled or connected to opposite sides of auger housing 130 and a second end pivotally coupled or connected to opposite sides of sweeper 400. Swing arms 440 are configured to pivot sweeper 400 between the lowered position shown in FIG. 13 in which the rotational axis sweeper 400 underlies rotational axis of auger 300 and underlies a bottom of auger housing 130 and the raised position shown in FIG. 14 in which sweeper 400 is positioned above auger housing 130 and above the mouth of auger housing 130.

In other implementations, swing arms 440 may alternatively be configured to move sweeper 400 between lowered and raised positions at which sweeper 400 extends at other positions or locations relative to auger housing 130. When in either the raised position or the lowered position, swing arms 440 are releasably locked or retained in place by one or more retaining mechanisms, such as a pin carried by one or both of swing arms 440 and resiliently biased towards a first detent in auger housing 130 when sweeper 400 is in the lowered position and a second detent in auger housing 130 when sweeper 400 is in the raised position. In other implementations, swing arms 440 may be pivoted by powered actuator, such as a hydraulic or pneumatic cylinder-piston assembly having one end pivotally coupled to auger housing 130 and another end coupled to swing arms 440, wherein the powered actuator also serves to retain swing arms 440 and sweeper 400 in either the raised or lowered position.

Sweeper drive 442 rotationally drive sweeper 400. At the same time, sweeper drive 442 permits sweeper 400 to be pivoted between the raised and lowered positions. FIG. 15 illustrates one example sweeper drive 442. Sweeper drive 442 comprises auger gear 414 (shown in FIG. 12), driven gear 418 (shown in FIG. 12), belt 422, pulley 446, gear 448 and gear 450. Belt 422 extends from driven gear 418 and wraps about pulley 446. Pulley 446 is operably coupled to gear 448 to rotate gear 448. Gear 448 has outer teeth in meshing engagement with outer teeth of gear 450. Gear 450 is fixed to center shaft 424 of sweeper 400 such that rotation of gear 450 rotates center shaft 424 and sweeper 400. Swinging of sweeper 400 out of the lowered position to the raised position disengages gear 450 from gear 448.

In one implementation, sweeper drive 442 is additionally configured to rotationally drive sweeper 400 and sweeper 400 is in the raised position. For example, in some implementations such as where sweeper 400 is adjacent the mouth of auger housing 300 to contact snow and drive snow into auger housing 300, it may be beneficial to rotationally drive sweeper 400. In such an implementation, sweeper drive 442 may additionally comprise driven gear 456, pulley 458, belt 460, pulley 462 and gear 464.

Driven gear 456 comprises a gear rotationally supported by auger housing 130 and having teeth in meshing engagement with teeth of auger gear 414 (shown in FIG. 12). Pulley 458 is fixed to gear 456 to rotate with gear 456. Belt 460 wraps about pulley 458 and wraps about pulley 462. Pulley 462 is fixed to gear 464. Gear 464 is rotationally supported by auger housing 130 and had teeth configured to be placed into meshing engagement with teeth of gear 450 when sweeper 400 is raised and retained in the raised position. Swinging of sweeper 400 out of the race position to the lowered position disengages gear 450 from gear 464.

Although not illustrated, in other implementations, sweeper drive 442 may include an additional gear rotationally supported by auger housing 130 between gear 464 and gear 450 when sweeper 400 is in the raised position. The additional intermediate gear, in meshing engagement both gear 464 and gear 450, changes the direction of rotation to rotationally drive sweeper 400 in an opposite direction. In other implementations, sweeper drive 442 may have other configurations. For example, in lieu of relying upon belt and pulley arrangements, sweeper drive 442 may alternatively utilize one or more of chain and sprocket arrangements or gear trains. In some implementations, the upper portion of sweeper drive 442 may be omitted, wherein sweeper 400 merely idles when in the raised position.

Figure 16:
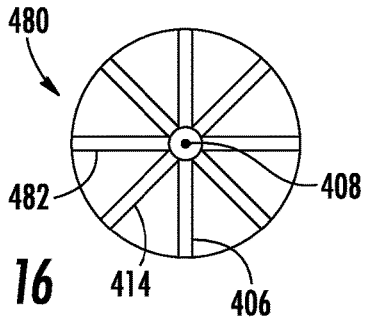
FIG. 16 is a side view of another example sweeper of the sweeper system of FIG. 13.

FIGS. 15 and 16 further illustrate different example implementations of sweeper 400. As shown by FIG. 15, in one implementation, sweeper 400 comprises a cylindrical brush having tines or bristles 470, 472. Bristles 470 have a longer length and a lower degree of rigidity (greater flexibility) as compared to bristles 472. Due to their greater rigidity, bristles 472 offer a greater degree of support for auger housing 130 (when sweeper 400 is in a lowered position) and offer greater ability to break up, dislodge and lift packed snow. At the same time, bristles 470, due to their longer length and increased flexibility, offer the ability to reach into crevices and cracks to remove snow. In the example illustrated, bristles 470 and 472 are intermingled amongst one another about a circumference of sweeper 400. In other implementations, bristles 470 and 472 may be clustered in groups or bands. In some implementations, sweeper 400 may be removably attached, allowing it to be interchanged with other sweepers having different characteristics to accommodate different snow characteristics.

FIG. 16 illustrates sweeper 480, another implementation of sweeper 400. Sweeper 480 is similar to sweeper 407 except that sweeper 480 includes a plurality of resilient flexible and bendable paddles 482 circumferentially arranged about rotational axis 408 of sweeper 480. In yet other implementations, sweeper 400 may have other configurations.

Figure 17:
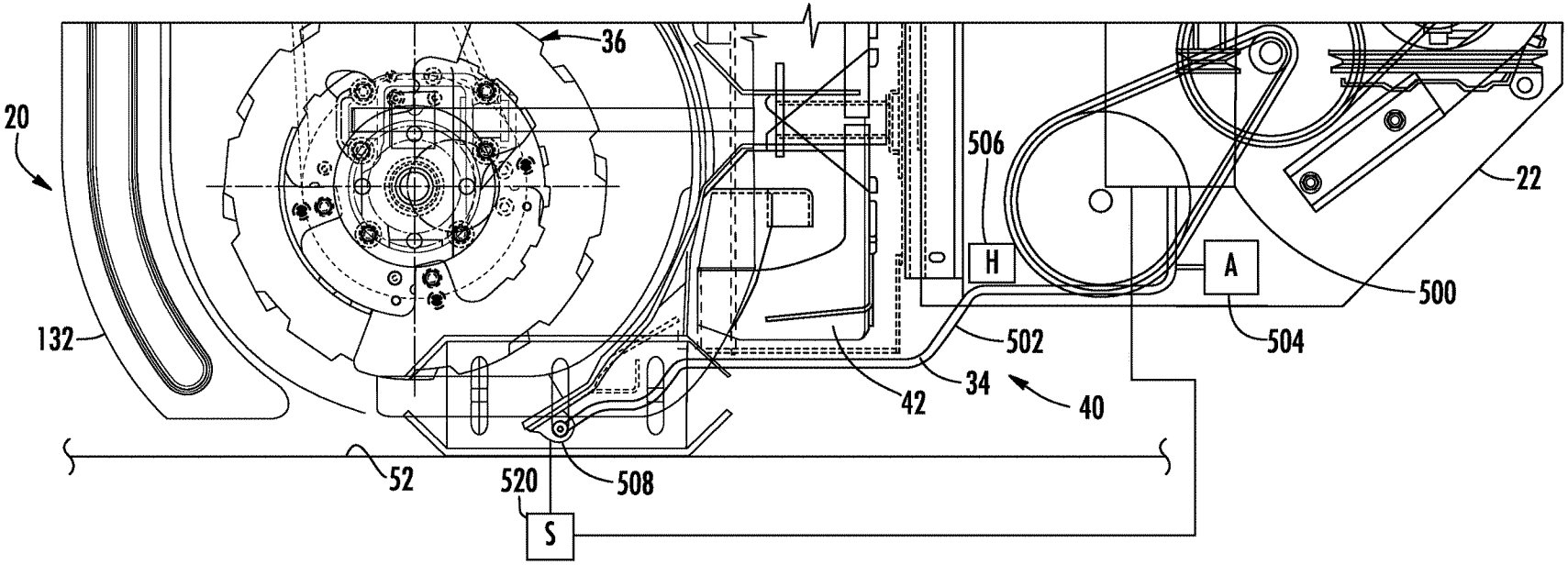
FIG. 17 is a side view of an example cutting system of the snow thrower of FIG. 1 with portions transparently shown.

Cutting system 40 comprises a system or mechanism to direct a fluid (gas and/or liquid) at packed snow (or ice). In the example illustrated, as shown by FIGS. 11 and 17, cutting system 40 comprises compressed gas source 500, tube or conduit 502, additive source 504, heater 506 and compressed gas knife 508. Compressed gas source 500 comprises source of compressed gas, such as compressed air. In other implementations, the compressed gas may comprise other types of gases. In one implementation, compressed gas source 500 comprises a compressor. In one implementation, compressed gas source 500 comprises a belt driven compressor, wherein a belt 511 is operably between pulley 512 connected to the vertical output shaft 60 and pulley 514 connected to an input shaft of the belt driven compressor 500 (as seen in FIG. 2). In other implementations, the powering of the compressor serving as source 580 connected to vertical output shaft 60 by a chain and sprocket assembly or a gear train. In other implementations, compressed gas source 500 may comprise a compressor that is electrically powered. In other implementations compressed gas source 500 may comprise one or more tanks of pre-compressed gas which are selectively discharged to knife 508.

Conduit 502 extends from compressed gas source 500 to compressed gas knife 508. Conduit 502 comprises a plenum, manifold or tube. In implementations where compressed gas source 500 extends adjacent to knife 508, conduit 502 may be omitted.

Additive source 504 (schematically shown) comprises a mechanism configured to supply one or more additives to the stream of compressed gas supplied by source 500. In one implementation, additive source 500 comprises a reservoir of one or more additives which are drawn into the stream of compressed gas flowing through conduit 502, such as along a venturi in conduit 502. In another implementation, additive source 504 includes a pump for actively pumping one or more additives, added a selectively adjustable rate, into the stream of compressed gas from source 500.

In one implementation, additive source 504 adds alcohol to the stream of compressed gas to facilitate melting of the compacted snow or ice. In another implementation, additive source 504 adds other melting ingredient such as a calcium chloride slurry, a liquid deicer or a liquid snow melter. In yet other implementations, additive source 504 may add one or more other additives or may be omitted.

Heater 506 comprises a device or mechanism to apply heat to the stream of compressed gas and/or additives flowing through conduit 502. In other implementations, heater 506 may heat the gas or additives prior to such gas are additives entering conduit 502. By applying heat to the gas and/or additives, heater 506 further enhances the ability of air knife 508 to cut through or breakup compacted snow and ice. In one implementation, heater 506 comprises one or more thermally conductive structures that thermally conduct heat from one or more portions of engine 26 to locations adjacent to conduit 502 to heat an interior of conduit 502. In another implementation, heater 506 comprises a conduit which channels air heated by engine 26 to conduit 502 to heat an interior of conduit 502 or to heat portions of source 500 or source 504. In one implementation, conduit 502 itself may extend adjacent to portions of engine 26 to receive heat from engine 26. In such implementations, at least portions of conduit 502 such as those portions extending adjacent to the heat transfer mechanisms of heater 506 may be formed from highly thermally conductive material such as aluminum or copper. As a result, heat generated by engine 26 that would otherwise be discharge may be recycled to assist in breaking up cutting through compacted snow.

In other implementations, heater 506 may comprise one or more electrically resistive heat generating coils encircling or extending adjacent to portions of conduit 502 or portions of sources 500, 504, wherein electric current is circulated across the coils to heat the gas and/or additives. In another implementation, heater 506 may alternatively or additionally heat the compressed gas source knife 508, wherein the heated portions of knife 508 may heat the gas or additives passing their through or wherein knife 508 itself may be brought into contact with compacted snow. In other implementations, heater 506 may be omitted.

Compressed air knife 508 comprises a mechanism configured and supported so as to direct the compressed gas and/or additives at the terrain 52 underlying snow thrower 20. In one implementation, knife 508 directs the compressed gas and/or additives at a forward angle, forward of lower edge of a mouth of auger housing 130. As shown by FIG. 11, in one implementation, knife 508 extends along a majority of an axial length of main auger 300. In one implementation, knife 508 comprises a manifold having a plurality of outlets, nozzles or orifices 512 dispose along edge 514 of scraper bar 516 located along a lower edge of a mouth of auger housing 130. In one implementation, the compressed gas and/or additives is directed toward at least one area ahead of main auger 300 and another area behind main auger 300. In one implementation, the compressed gas and/or additives are directed forward a rotational axis of main auger 300 also being directed rearward of the rotational axis of main auger 300.

In one implementation, knife 508 directs the gas/additives forwardly of the edge 514 of scraper bar 516. In one implementation, the orifices 512 extend at different angles towards the underlying terrain 52. Because the gas and/or additives are directed at different angles at different locations in the pack snow, the gas and/or additive may more effectively breakup the pack snow.

In the example illustrated, the compressed gas or compressed air is provided a pressure and rate to remove snow that is not removable by auger 300, such as compacted or compressed snow. In one implementation, the compressed gas is pulsed. In one implementation, the pulses of the compressed gas are user adjustable between a plurality of non-zero pulsed settings.

In one implementation, characteristics of the compressed gas and/or additives (the selection of additives or the rate at which additives are added) may be varied in response to signals received from one or more sensors 520 which detect one or more characteristics of the snow. For example, in one implementation, optical sensors may be utilized to detect a degree to which the snow is compacted. Based on signals from such optical sensors, controller may turn on or turned off the supply of compressed gas and/or the addition of additives. In one implementation, the controller may adjust characteristics of the compressed gas and/or characteristics of the additive being supplied through manifold knife 508. In one implementation, the angle at which compressed air and/or additives is directed toward the snow or the specific nozzles or orifices from which the compressed gas and/or additives may be controlled or adjusted based upon such signals. For example, compressed gas at different pressures may be ejected from different orifices.

In one implementation, the pulse at which compressed gas is supplied by source 500 or released by knife 508 may be adjusted based upon signals from sensor 520. In one implementation, the signal from sensor 520 may additionally or alternatively be utilized to control the heating provided by heater 506. In one implementation, sensors 520 may additionally or alternatively include a temperature sensor, wherein adjustments are made by controller in response to the sensed temperature. For example, heat being supplied by heater 506 may be increased in response to the sensing of extremely cold temperatures falling below a predefined threshold. In one implementation, each of the aforementioned characteristics such as the heat being supplied by heater 506, the existence or mixture of additives being supplied by additives source 504 and the characteristics of the compressed gas being supplied by source 500 or being released by knife 508 may be adjusted by one or more actuators actuated in response to control signals from a controller based upon one or more sensors or based upon manual inputs or control adjustments made by the user.

Impeller 42 comprises a rotatable snow moving member within impeller housing 34 that is configured to receive snow from auger system 36 burn opening within auger housing 130 and is further configured to throw or impel such snow through an opening in impeller housing 34 and through chute assembly 44. As noted above, in one implementation, impeller 42 has an outer diameter larger than the outer diameter of main auger 300, wherein the smaller outer diameter of main auger 300 allows auger housing 130 to be shallower such that are housing 130 may be formed from a single layer or sheet of material that is deformed, bent or deep drawn and wherein the larger diameter of impeller 42 maintains the throw distance for snow thrower 20.

Chute assembly 44 directs the snow impelled by impeller 42 away from snow thrower 20 in one or more directions. Chute assembly 44 comprises lower or main chute 600, main chute rotating system 602, deflector 604 and deflector deflection system 606. Main chute 600 comprises a tubular structure extending upward from an opening within impeller housing 34.

Figures 18, 19:
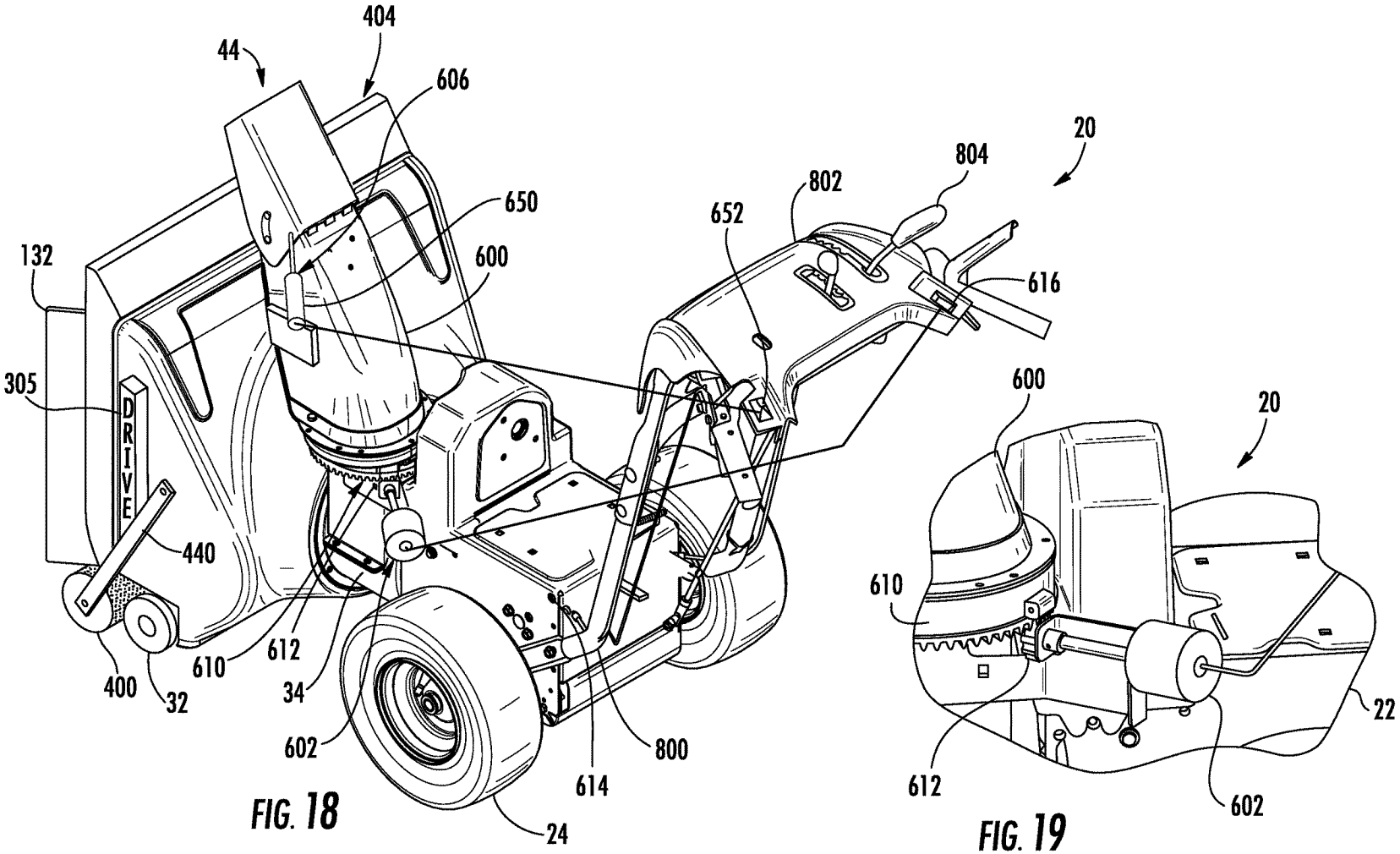
FIG. 18 is a rear perspective view of the snow thrower of FIG. 1.
FIG. 19 is a fragmentary perspective view of the snow three of FIG. 1 illustrating an example chute assembly.

Main chute rotating system 602 comprise a mechanism configured to rotate main chute 600 about a vertical or a substantially vertical axis. In the example illustrated, main chute rotating system 602 utilizes one or more powered (rotational torque not being directly manually generated) sources. FIGS. 18 and 19 illustrate one particular example implementation of main chute rotating system 602. As shown by FIG. 18, system 602 comprises annular ring gear 610, pinion gear 612, actuator 614 and manual control 616.

Annular ring gear 610 is affixed to main chute 600 so as to rotate with main chute 600. Gear 610 has downwardly facing teeth enmeshed engagement with pinion gear 612. Pinion gear 612 is operably coupled to actuator 602 for being rotated by actuator 602. In the example illustrated, actuator 602 comprises an electrically powered motor (powered off of a battery). In the example illustrated, actuator 602 comprises a precisely controllable motor, such as a step motor or servomotor. Actuator 602 is connected to manual control 616 in a wired or wireless fashion (as schematically shown). Manual control 616 comprises a device configured to control actuator 602 in response to manual inputs from a person. In the example illustrated, manual control 616 comprises a three position toggle switch, wherein the depressment of one side of the switch results in rotation of main chute 600 in a first direction, wherein the depressment of the other side of the switch results in rotation of main chute 600 in a second opposite direction and wherein the switch in the neutral default position maintains chute 600 in a stationary position. In other implementations, other rotary actuators and other manual controls may be utilized. In still other implementations, actuator 614 and manual control 616 may be omitted, wherein rotational torque for rotating pinion gear 612 and chute 600 may alternatively be generated manually through the use of a manual crank.

Figure 20:
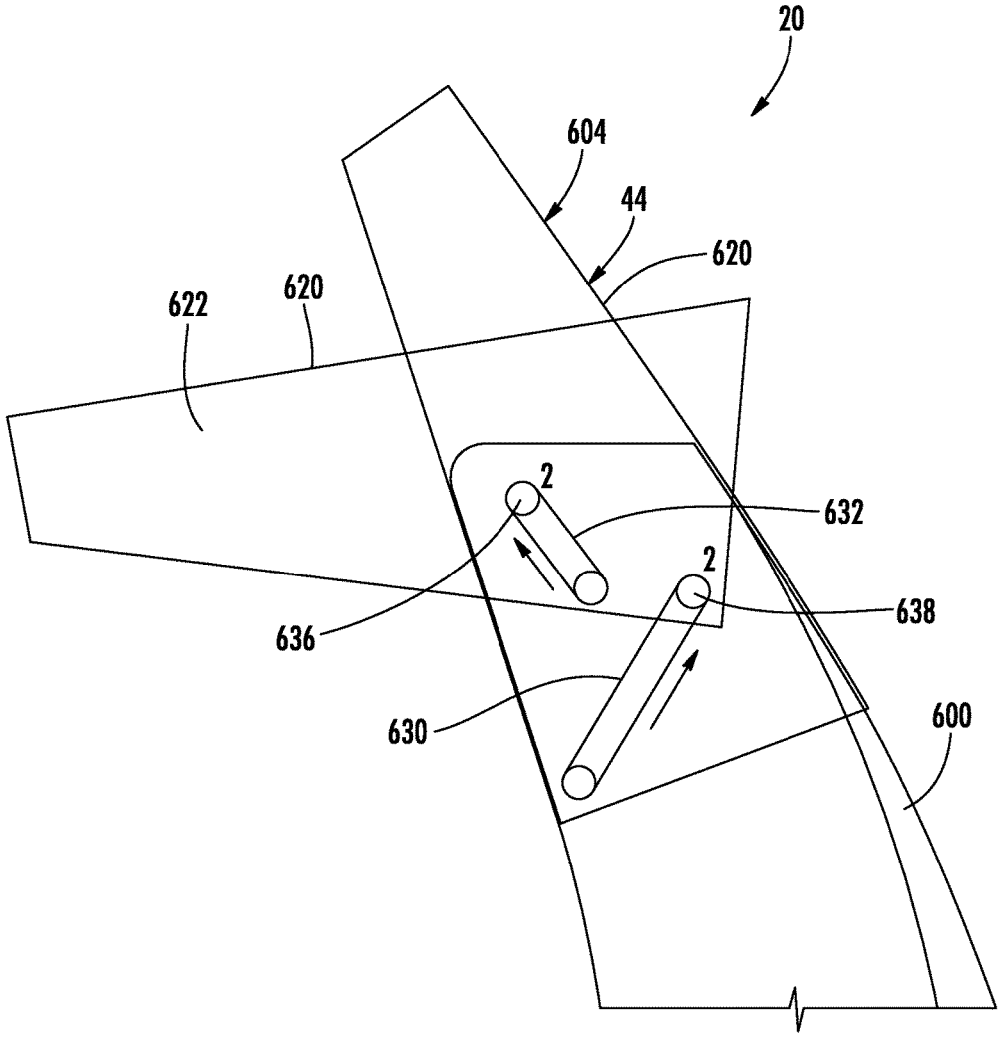
FIG. 20 is a side view of an example chute of the assembly of FIG. 19 with portions transparently shown to illustrate movement of the chute between two positions.

Deflector 604 receives snow from main chute 600 and directs or deflects the snow at one of a plurality of selected angles with respect to horizontal. The selected angle impacts the height of the snow being thrown and the location at which the thrown snow lands. FIG. 20 illustrates deflector 604 in more detail. As shown by FIG. 20, deflector 604 is configured to telescope with respect to main chute 600.

In the example illustrated, deflector 604 comprises a tubular chute member having a top wall 620 and a pair of sidewalls 622. In the example illustrated, deflector 604 is open opposite to top wall 620. In the example illustrated, lower main chute 600 has one of projections and detents well the upper chute or deflector 604 has the other of projections and detents, wherein at least one of the chute 600 and deflector 604 resiliently flex to permit projections to be snapped into the detents and wherein the projections and the detents cooperate to permit pivoting of deflector 604 relative to chute 600. In the example illustrated, main chute 600 includes an elongate slot 630 while deflector 622 has an elongate slot 632. Main chute 600 has a projection 636 received within slot 632 while deflector 604 has a projection 638 received within slot 630. Slots 630, 632 and projection 636, 638 form a four-bar linkage facilitating pivoting and telescoping of deflector 604 with respect to main chute 600. As a result, deflector 604 may be positioned outside of a normal arc. Deflector 604 and chute 600 may additionally be attached through a simple manual snapping into place.

FIG. 20 illustrates the repositioning of deflector 604 as a result of pivoting of deflector 604 such that projection 636 moves from position 1 to position 2 within slot 632 and such that projection 638 moves from position 1 to position 2 in slot 630. In other implementations, the shape of slots 630, 632 and their relative positions may be adjusted to provide different available paths or arcs for deflector 604. In other implementations, in lieu of slots and pins, deflector 604 and main chute 600 may utilize other projections and detents, such as tongue grooves and the like.

As shown by FIG. 18, deflector deflection system 606 comprise a mechanism to selectively reposition deflector 604 with respect to chute 600 and to retain deflector 604 in a selected one of a plurality of available positions. In the example illustrated, system 606 comprises actuator 650 and manual control 652. Actuator 650 comprises a powered device (torque or force to reposition deflector 604 not being manually provided) to move deflector 604. In the example illustrated, actuator 650 comprises a linear actuator having one end attached to main chute 600 and a second end pivotally connected to deflector 604. In the implementation shown, actuator 650 comprises an electric solenoid (powered by a battery) mounted chute 600 and pivotally attached to deflector 604. In other implementations, actuator 650 may comprise a linear actuator such as a hydraulic or pneumatic cylinder-piston assembly having one portion fixed to chute 600 and a second portion (the piston) pivotally coupled to deflector 604. Actuator 650 is in communication with and connected to manual control 652 in a wired or wireless fashion (as schematically shown).

Manual control 652 comprises a device configured to control actuator 650 in response to manual inputs from a person. In the example illustrated, manual control 652 comprises a three position toggle switch, wherein the depressment of one side of the switch results in pivoting of deflector 604 in a first direction, wherein the depressment of the other side of the switch results in pivoting of deflector 604 in a second opposite direction and wherein the switch in the neutral default position maintains deflector 604 in a stationary position. In other implementations, other actuators (rotary and linear) and other manual controls may be utilized. In still other implementations, actuator 650 and manual control 652 may be omitted, wherein repositioning of deflector 604 may alternatively be performed through the direct application of manual force to deflector 604 and wherein the selected position may be secured through use of a manually actuated set screw and the like.

Figure 21:
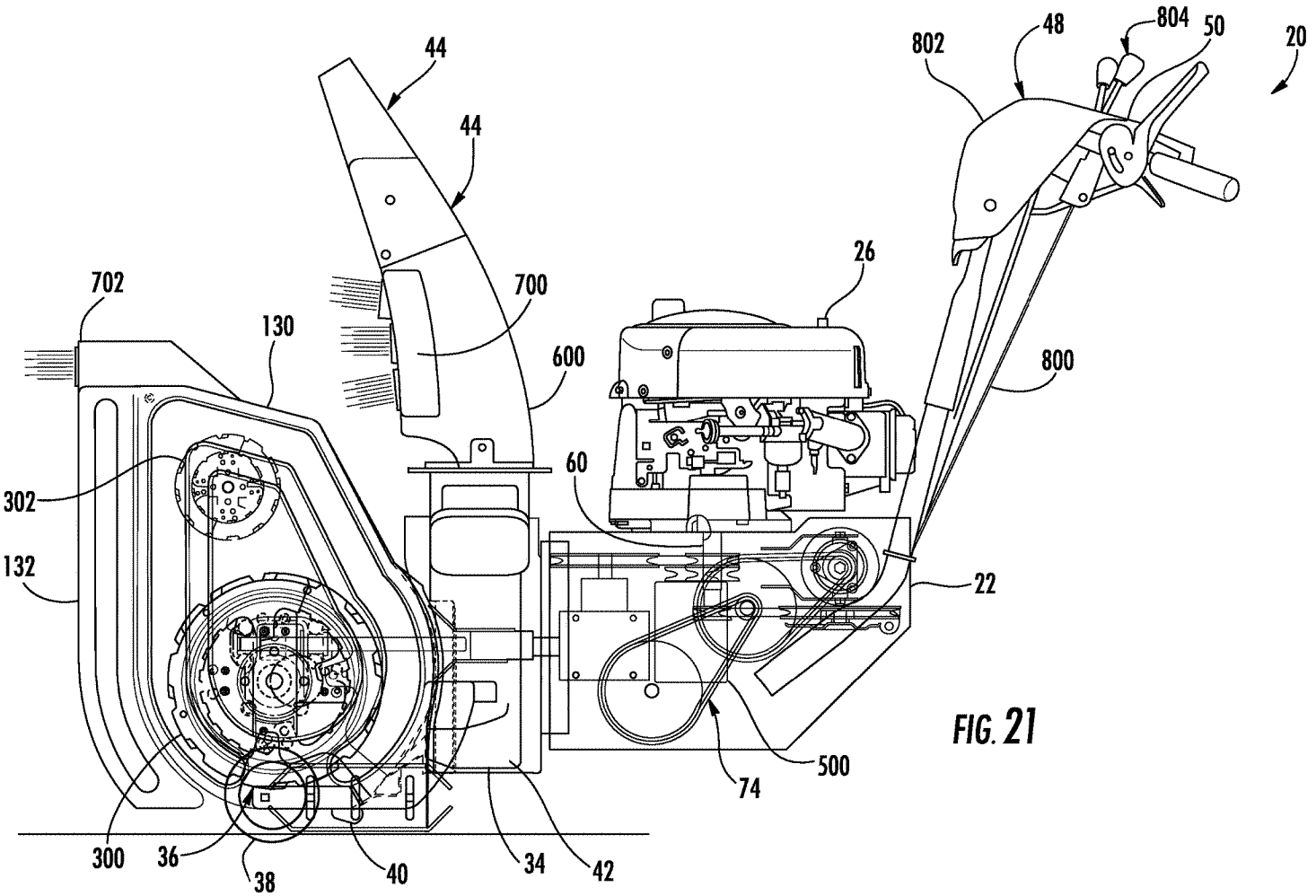
FIG. 21 is a side view of the snow thrower of FIG. 1 illustrating an example lighting system.
Figure 22:
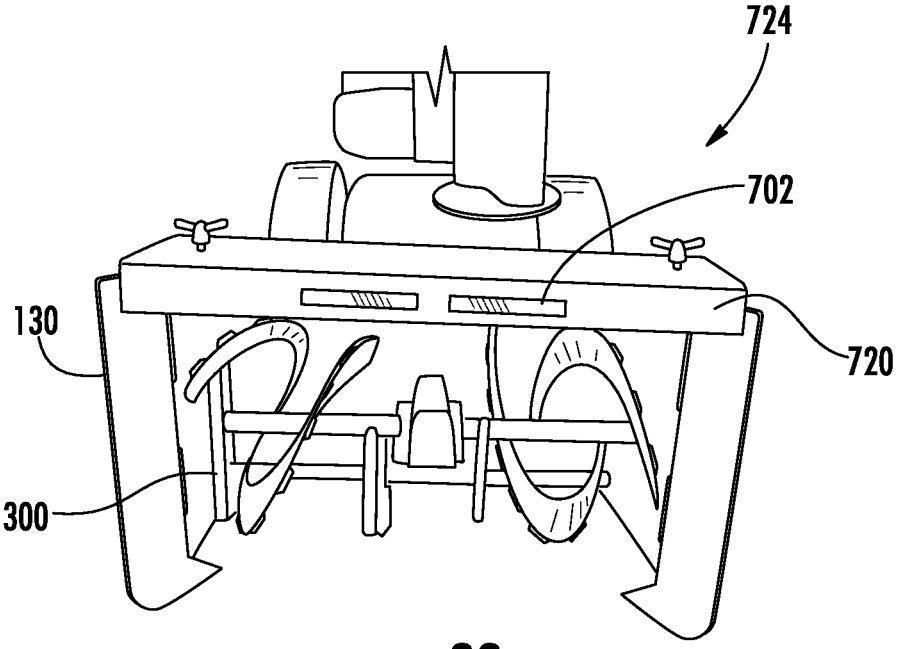
FIG. 22 is a front view of the snow thrower of FIG. 21.
Figure 23:
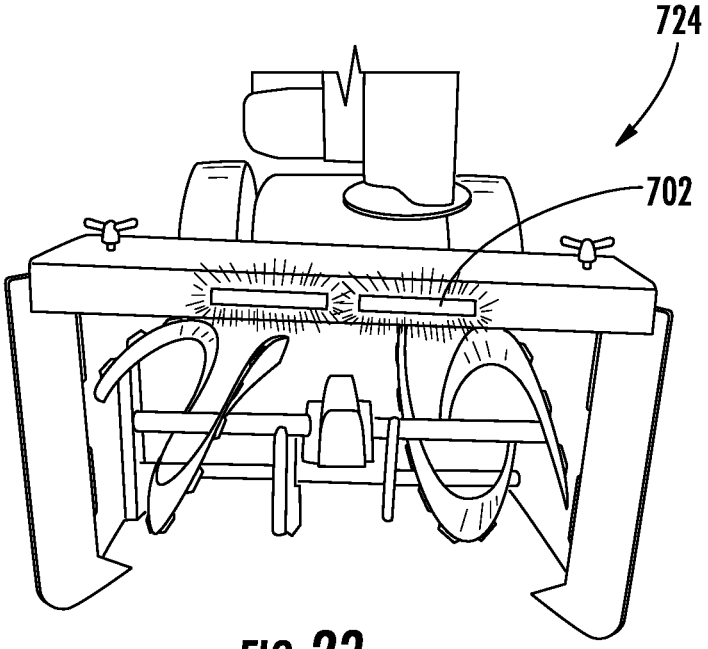
FIG. 23 is another front view of the snow for of FIG. 21.
Figure 24:
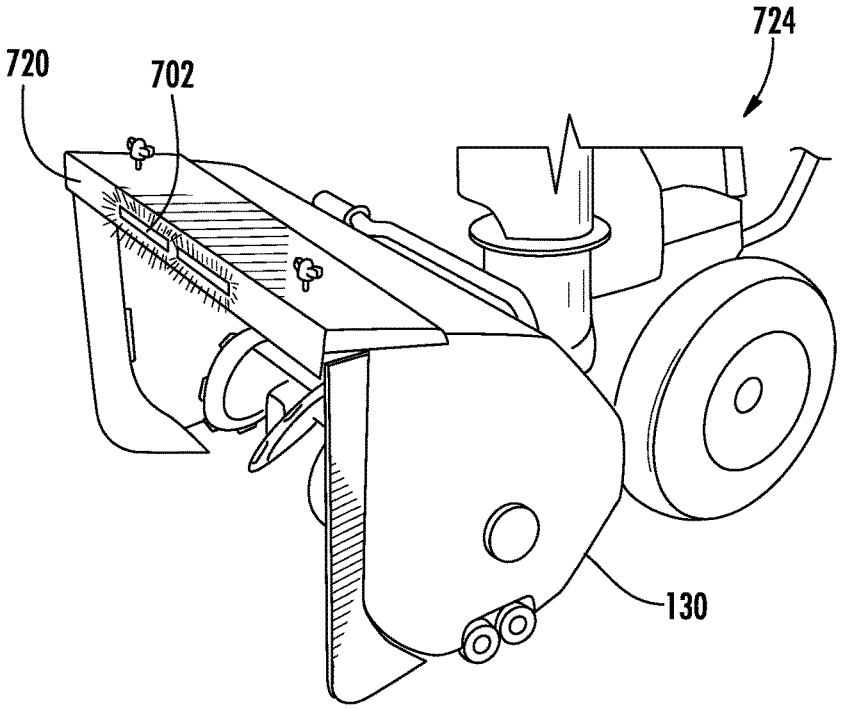
FIG. 24 is a front perspective view of the snow thrower of FIG. 21.
Figure 25:
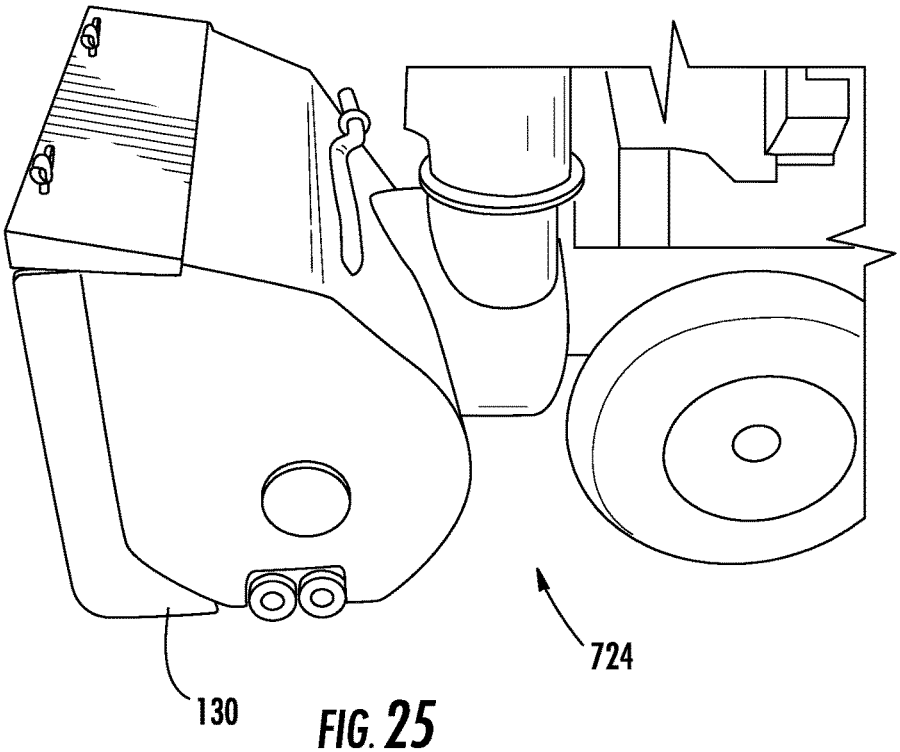
FIG. 25 is a another front perspective view of the snow third of FIG. 21.

Lighting system 46 supplies and directs light to regions proximate to snow thrower 20. As shown by FIGS. 11 and 21, lighting system 46 comprises chute mounted lights 700 and auger housing mounted lights 702. Chute mounted lights 700 comprise one or more sources of light (powered by a battery or other energy source) mounted to or coupled to lower main chute 600 configured to emit light in a forward direction with respect to chute 600 as indicated by arrows 706. In the example illustrated in FIG. 21, lights 700 include a top-flight focus up and to one side, a center light focused straight ahead and a bottom light focused down and out to the other side, wherein a wide zone is illuminated. In other implementations, the focusing of such lights may be different. Because lights 700 are mounted to main chute 600 which is selectively rotatable (as described above), the area being lit by lights 700 may be also selected in response to a person rotating chute 600. In other words, lights 700 may be aimed by the user using the same mechanism that rotates main chute 600.

Housing mounted lights 702 comprise one or more sources of light (powered by a battery or other energy source) mounted to auger housing 130 or otherwise provided above and adjacent to the mouth of auger housing 130. In the example illustrated, lights 702 or carried by a rim 710 of auger housing 130. Lights 702 aim or focus light in a forward direction in front of auger housing 130. Because lights 702 are mounted along the rim of auger housing 130, lights 702 are closest to the front of snow thrower 20, being able to better illuminate regions in front of snow thrower 20.

Lights 702 cooperate with lights 700 to provide a composite lit region which includes both regions in front snow thrower 20 as well as regions to either side of snow thrower 20. In particular, lights 702 illuminate areas in front of snow thrower 20 while light 700, upon the rotation of chute 600, illuminate areas to a side of snow thrower 20. As a result, the person using snow thrower 20 cannot only better see where he or she is pushing or driving snow thrower 20, but also where the snow is being thrown by snow thrower 20. In other implementations, other light sources may be employed. In other implementations, one or both of light sources 700, 702 may be omitted.

FIGS. 22-25 illustrate snow thrower 724, another example implementation of a snow thrower 20 including another example implementation of lighting system 46. Snow thrower 724 is similar to snow thrower 20 except that snow thrower 724 includes alternative locations for light sources 702. In the example shown in FIGS. 22-25, a top panel or top wall of water housing 130 has a downwardly bent rim 720 upon a front surface of which are mounted light sources 702. Power supply to such light sources through or along a backside of auger housing 130 behind rim 720. In other implementations, a top surface of our housing 130 may be provided with one or more solar panels which may be used to collect solar energy which is stored in a battery in later use by light sources 702 for powering light sources 702 when needed.

Figure 26:
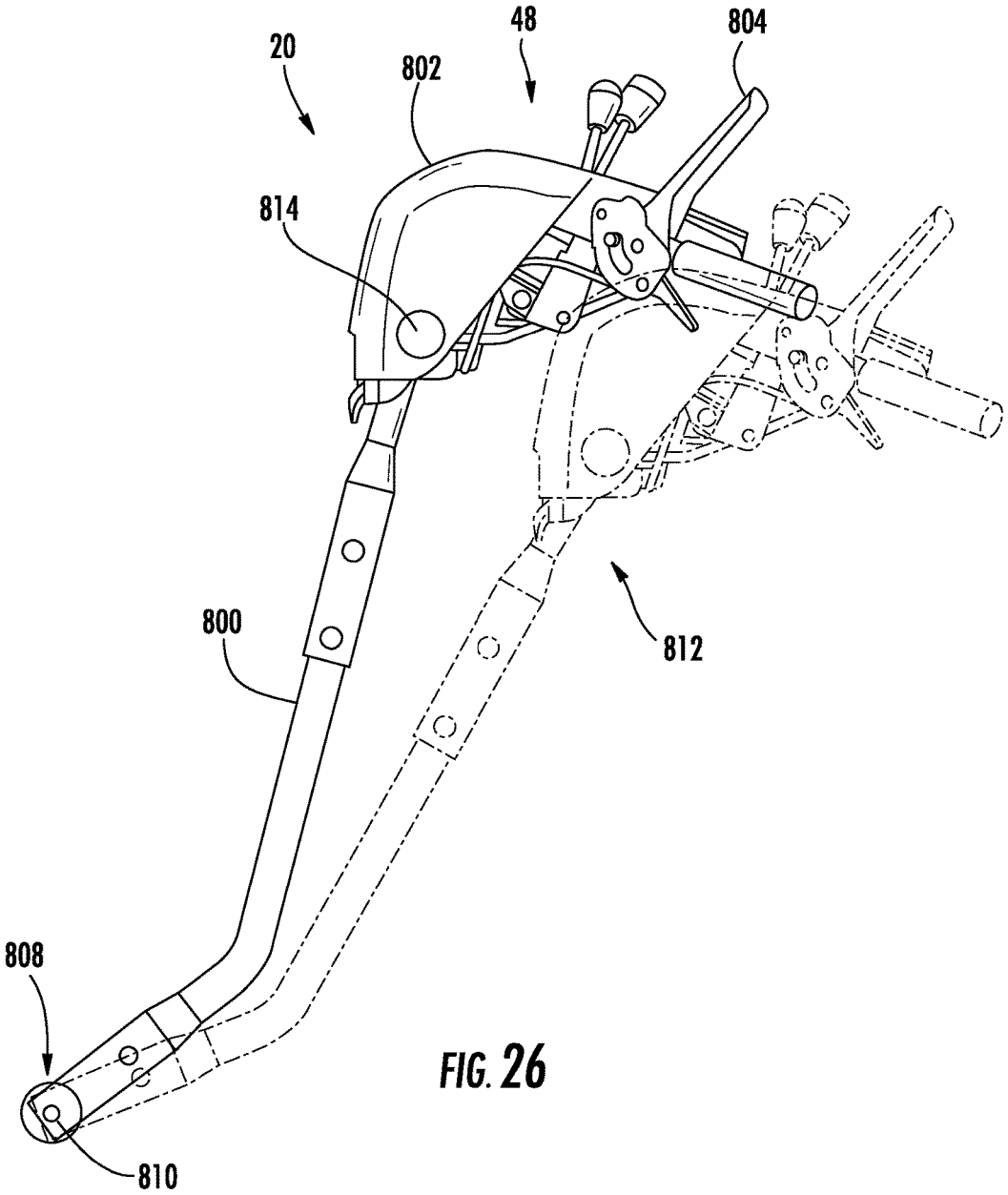
FIG. 26 is a side view illustrating an example handle arrangement of the snow thrower FIG. 1 in different positions.

Handle arrangement 48 comprises a handle mechanism by which a person may push and/or steer snow thrower 20 as well as control operation of snow thrower 20. Handle arrangement 48 (shown in FIG. 1) accommodates persons of different height and preferences. As shown by FIG. 26, handle arrangement 48 comprises arms 800, dashboard 802 and manual inputs 804.

Arms 800 comprise bars, rods or other elongated structures having a first end portion 808 pivotally connected or coupled to frame 22 (shown in FIG. 1) for pivotal movement about a horizontal axis 810 and a second end portion 812 pivotally connected to dashboard 802 for pivotal movement about a horizontal axis 814.

Dashboard 802 comprises one or more structures extending generally above arms 800 and pivotally connected arms 800 about axis 814. Dashboard 802 carries or supports one or more manual controls 804. As shown by FIG. 26 which illustrates two alternative positions for handle arrangement 48, arms 800 may pivot about axis 810 in a first direction while dashboard 802 pivots about axis 814 in a second opposite direction such that the overall height of handle arrangement 48 may be reduced or increased while reducing or minimizing a change in the horizontal or angular orientation of dashboard 802 and the supported manual controls 804. In addition, not only the height of dashboard 802 may be adjusted, but also its horizontal positioning. In such an example, handle arrangement 48 offers four repositioning points, the extreme positions or endpoints of the arcs about axes 810 and 814 at any point between which arms 800 and dashboard 802 may be selectively positioned and retained.

Manual controls 804 comprise devices by which manual inputs may be provided to snow thrower 20. As noted above, examples of manual controls 804 include manual controls 616 and 652 utilized to control the positioning of main chute 600 and deflector 604. Manual controls 804 further include controls to adjust the speed at which snow thrower 20 is being propelled are driven as well as to adjust the speed or torque of auger system 36 and impeller 42. As schematically shown by FIG. 1, in one implementation, snow thrower 20 includes a controller 820 operably coupled to one or more actuators (solenoids and the like), wherein the controller generates control signals causing the actuators to selectively adjust output of engine 26 and/or the transmission of snow thrower 20.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 820 may be embodied as part of one or more application-specific integrated circuits (ASICs). Unless otherwise specifically noted, the controller is not limited to any specific combination of hardware circuitry and software, nor to any particular source for the instructions executed by the processing unit.

Controller 820 generates such control signals (for adjusting output of the engine 26 or its associated transmission to adjust a speed at which snow thrower 20 is driven or propelled and/or to adjust a speed or torque of auger system 36 or impeller 42) in response to input to manual inputs or controls 804 which results in electrical control signals being transmitted through an electrical transmitting line 824 (schematically shown) to controller 820. For example, one or more of manual controls 804 may include one or more electrical switches which caused the generation of electrical control signals which are transmitted or otherwise communicated to controller 820. Because snow thrower 20 utilizes electronics and electrical signals generated at dashboard 802 to control the operation of snow thrower 20, rather than push pull cables and other force-type transmission mechanisms that rely upon the transmission of force from the handle to control the operation of snow thrower 20, handle arrangement 48 may be moved through such multiple pivot points and arcs for user customization without impacting the transmission of control inputs. In particular, with push pull cables and other force type control transmissions, repositioning of the handle may impact the length or path of the push pull cable which may impact the receipt of control inputs. Because snow thrower 20 utilizes electrical signals, such variations are omitted; the control system of snow thrower 20 offers greater consistency and reliability.

In other implementations, electrical transmitting line 824 may be omitted, where such control signals are communicated wirelessly in response to inputs provided by manual controls 804 on dashboard 802. In other implementations, push pull cables may be utilized to transmit control adjusting actions entered by manual controls 84 to controller 26 or directly to the actuators associate with engine 26 or the transmission.

Figure 27:
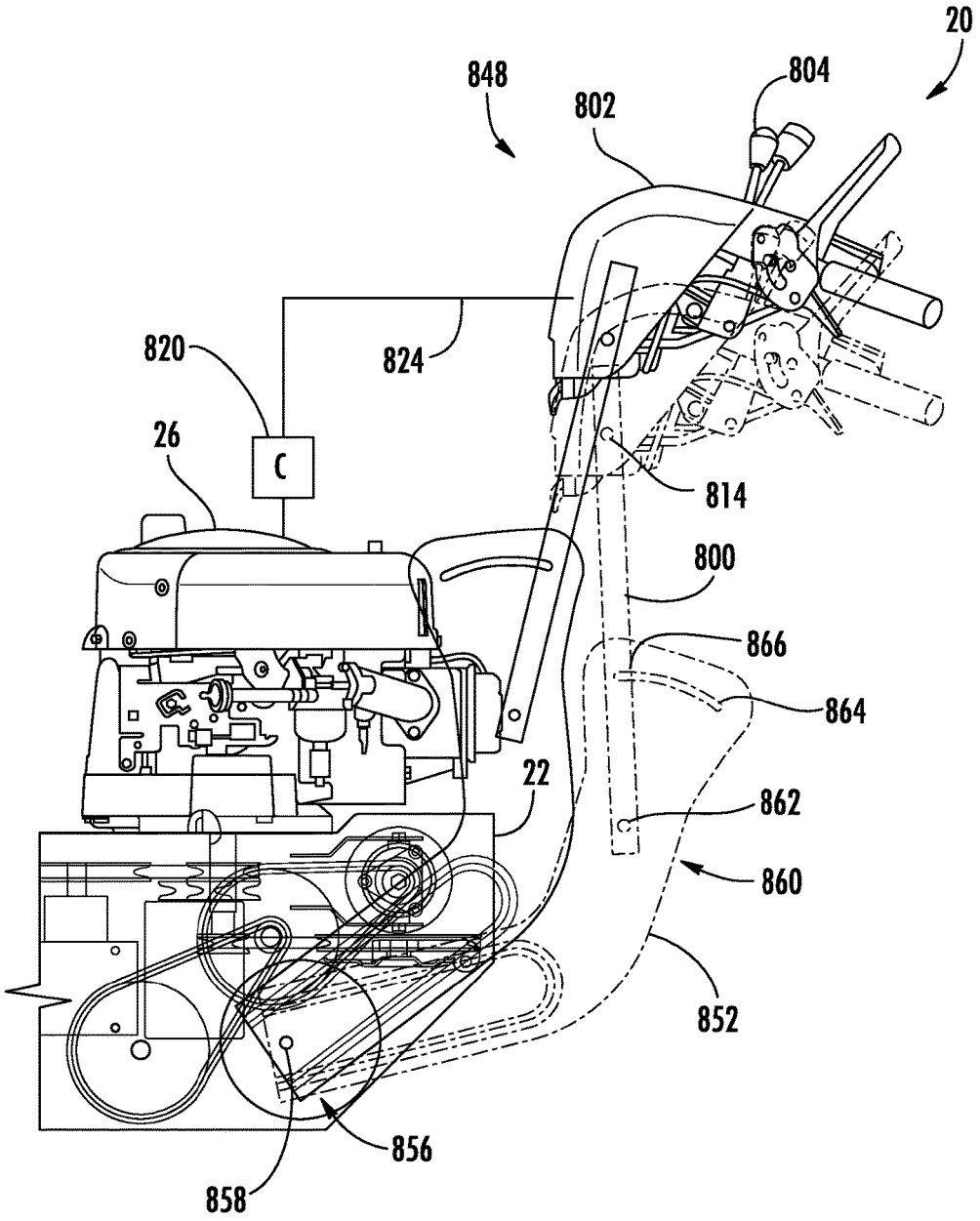
FIG. 27 is a side view of the snow thrower FIG. 1 with another example handle arrangement in different positions.

FIG. 27 illustrates snow thrower 20 with handle arrangement 848, an alternative implementation handle arrangement 48. Handle arrangement 848 is similar to handle arrangement 48 except that handle arrangement 848 additionally includes lower arms 852 (two alternative positions of the pair of arms 852 being shown). Each of the lower arms 852 includes a lower portion right 56 housing 22 for pivotal movement about a horizontal axis 858 and a second portion 860 pivotally connected to one of arms 800 for pivotal movement about a horizontal axis 862. Each lower arm 852 further includes an elongate slot 864 receiving a projection or pin 866 projecting from the associated arm 800. Slot 864 slide receives pin 866 to limit an extent to which arm 852 may pivot about axis 862 with respect to arm 852. Each of arms 800, 852 and dashboard 802 are selectively retained in one of a plurality of positions by one or more retainers or retaining mechanisms, such as pins and detents (not shown).

As shown by FIG. 27 which illustrates two alternative positions for handle arrangement 848, arms 852 may pivot about axes 858, arms 800 may pivot about axis 866 in a first direction while dashboard 802 pivots about axis 814 in a second opposite direction such that the overall height of handle arrangement 48 may be reduced or increased while reducing or minimizing a change in the horizontal orientation of dashboard 802 and the supported manual controls 804. In addition, not only the height of dashboard 802 may be adjusted, but also its horizontal positioning. In such an example, handle arrangement 48 offers six repositioning points, the extreme positions or endpoints of the arcs about axes 858, 862 and 814 at any point between which arms 858, 800 and dashboard 802 may be selectively positioned and retained. In such an implementation, dashboard 802 may be vertically moved without any horizontal movement of dashboard 802.

Figure 28:
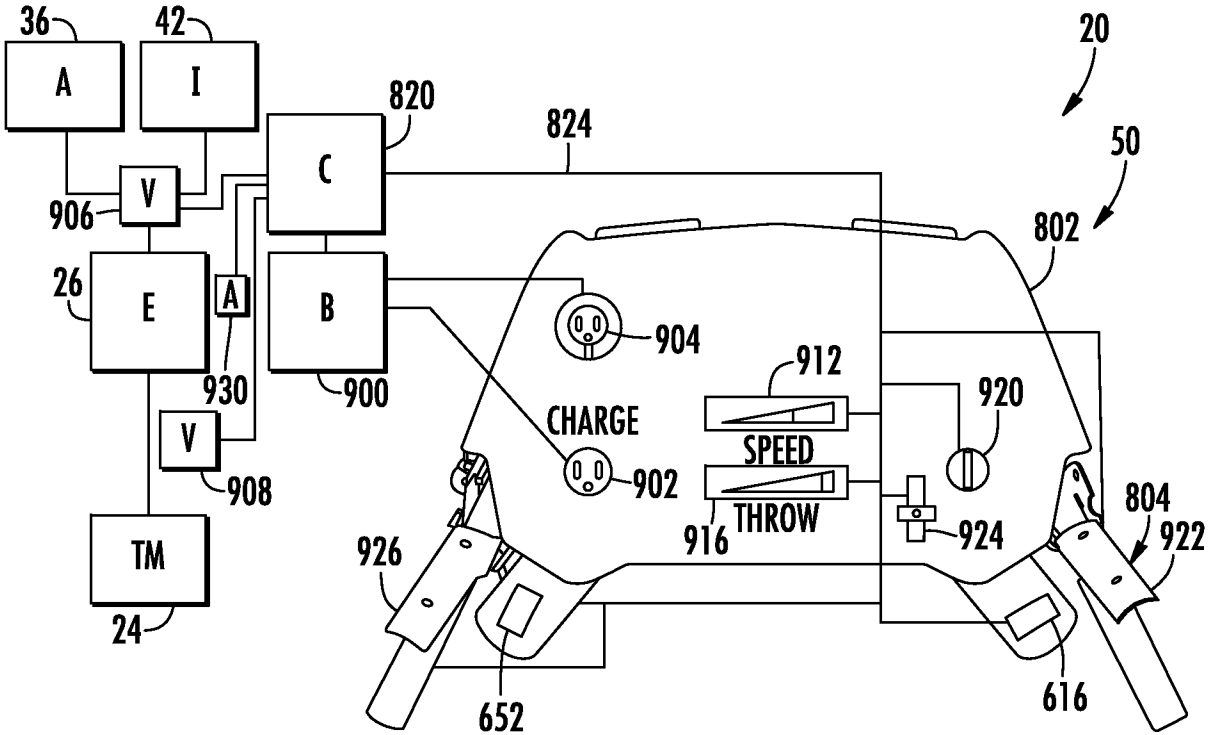
FIG. 28 is a schematic diagram of an example control system of the snow thrower a FIG. 1.

Control system 50 facilitates user control of the operation of snow thrower 20. FIG. 28 schematically illustrates control system 50. As shown by FIG. 28, control system 50 comprises battery 900, female charging port 902, retractable charging plug 904, variator 906, variator 908, manual inputs or manual controls 804 (also forming part of handle arrangement 48), speed display 912 and throw display 916. Although not illustrated, in other implementations, control system 50 may include additional display elements and additional manual controls. Battery 900 comprises a rechargeable battery supported by frame 22 for storing and supplying power to snow thrower 20.

Female charging port 902 comprise a female electrical port for being connected to a male plug of electrical cord to allow battery 900 to be connected to an electrical outlet for charging battery 900 or for directly supplying power to snow thrower 20 during starting of engine 26. In the example illustrated, female charging port 902 is housed or supported in dash panel or dashboard 802. In other implementations, port 902 may have other locations on snow thrower 20.

Retractable charging plug 904 comprise a male electrical plug at the end of a retractable coil. Plug 904 is configured to be pulled from snow thrower 20 and connected to inlet outlet for charging battery 900 or for supplying and directing power during starting of engine 26. In the example illustrated, plug 904 and its retractable coil are provided on dash panel or dashboard 802. In other implementations, plug 904 may extend from other portions of snow thrower 20.

Variator 906 comprise a mechanical variator operably coupled between engine 26 and auger system 36 an impeller 42 as part of the transmission of snow thrower 20. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. The term "fluidly coupled" shall mean that two are more fluid transmitting volumes are connected directly to one another or are connected to one another by intermediate volumes or spaces such that fluid may flow from one volume into the other volume.

Variator 906 is configured to vary or split power being delivered to auger system 36 and impeller 42 such that auger system 36 may be driven at a different speed and/torque as compared to impeller 42. In one implementation, variator 906 comprises a frictional mechanical variator. In other implementations, other forms of a variator may be employed.

Variator 908 comprise a mechanical variator operably coupled between engine 26 and traction members 24 as part of the transmission of snow thrower 20. Variator 908 is configured to vary or split power being delivered to traction members 24 as compared to the power being delivered to auger system 36 and impeller 42 such that traction members 24 may be driven at a speed different than the speed at which impeller 42 is driven or the speed at which auger system 36 is driven. In one implementation, variator 906 comprises a frictional mechanical variator. In other implementations, other forms of a variator may be employed. In other implementations, one or both of variator 906, 908 may be omitted.

Manual controls 804 comprise inputs by which a person control snow thrower 20. Manual controls 804, provided on dashboard 802, comprise controls 616 and 652, starter control 920, traction drive control 922, auger control 924 impeller or throw control 926. Controls 616 and 652 control the positioning of main chute 600 and deflector 604, respectively, and are described above.

Starter control 920 comprises a turnkey, the position of which is sensed, such as with a potentiometer, to generate electrical signals which are transmitted to controller 820 to initiate starting of engine 26 and the continued operation of engine 26. Traction drive control 922 comprises a pivotable lever, the position of which is sensed, such as with a potentiometer, to generate electrical signals which are transmitted to controller 820 to control an on-off state and the speed at which traction members 24 are driven to move snow thrower 20. Auger control 924 comprises a slide bar or pivotable lever, the positioning of which is sensed, such as with a potentiometer, to generate electrical signals which are transmitted to controller 820 to control a speed of auger system 36. Throw control 926 comprises a pivotable lever, the position of which is sensed, such as with a potentiometer, to generate electrical signals which are transmitted to controller 822 control a speed of impeller 42. Each of such controls are merely exemplary in nature. In other implementations, each manual control 804 may have a different configuration.

Speed display 912 comprises a visible display indicating on dashboard 802 the speed at which traction members 24 are being driven. Throw display 916 comprises a visible display indicating on dashboard 802 the speed at which impeller 42 is being driven. In the example illustrated, speed display 912 and throw display 916 comprises triangular displays wherein a region is filled in or underline is presented to indicate the present state with respect to the minimum and maximum velocities. In one implementation, the line or region may comprise a dial or member which moves in response to control signals provided by controller normally 20. In another implementation, line or region may be provided by light emitting diodes and the like. In other implementations, displays 912 and 916 may have other configurations. For example, displays 912 and 916 may alternatively comprise dials, alphanumeric displays and the like. Displays 912 and 916 provide a person with a visual indication of the speed at which the snow thrower's being driven as well the speed at which impeller 42 is being driven (corresponding to the distance at which snow may be being thrown). In other implementations, one or both of displays 912, 916 may be omitted or additional displays may be provided.

Controller 820 comprises one or more processing units configured to generate control signals directing operation of engine 26, variator 906, 908 and displays 912, 916. Controller 820 generates such control signals in response to electrical signals received from manual controls 804 as well from one or more sensors associated with snow thrower 20. As noted above, in some implementations, controller 20 may additionally generate control signals controlling the operation of cutting system 40.

In operation, battery 900 is charged through port 902 or plug 904. Power from battery 900 may be utilized to power lighting system 46, cutting system 40 as well as control system 50. In some implementations, power from battery 900 may be utilized in place of engine 26 for powering one or more of auger system 36, sweeper system 38, impeller 42 or traction members 24. In one implementation, snow thrower 20 may include an onboard generator for charging battery 900 or for powering some of the aforementioned components.

In response to input received by manual controller relying 20, electrical signals are transmitted to controller 820. In response to such signals, controller 820 generates control signals to one or more actuators 930 which set a choke associated with engine 26, prime engine 26 and turnover engine 26 to start engine 26. Such actuators 930 may comprise electric solenoids, like the switches and the like. As a result, start up of snow thrower 20 is accomplished in a single step, actuation of controller 920. In other implementations, such startup steps may be individually carried out in response to actuation of multiple separate manual controls.

During operation of the snow thrower 20, controller 820 generate control signals based upon input via manual control 804 to adjust the speed are operation of traction members 24, auger system 36 and impeller 42. In one implementation, controller 820 transmits signals to display 912 and display 916 causing such displays to visibly present information regarding the current speed of traction members 24 and the current velocity of impeller 42, respectively. In one implementation, controller 828 generates such control signals based upon the actual control signals transmitted by controller 820 to engine 26, or variators 906, 908 which correspond to such speed. In another implementation, controller 820 may generate such signals for displays 912 and 916 based upon one or more sensors sensing the actual speed of traction members 24 and impeller 42.

Figure 29:
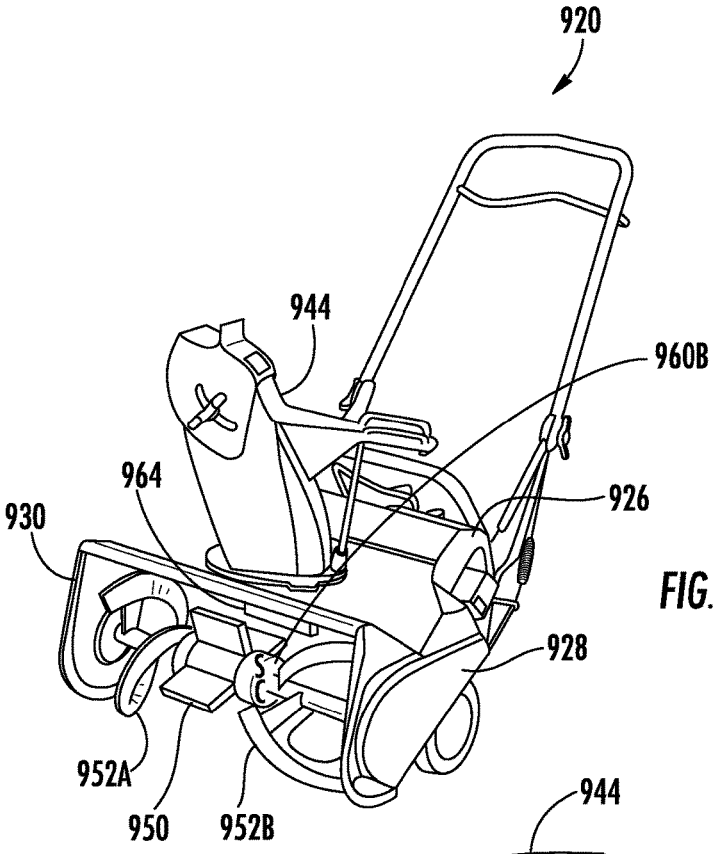
FIG. 29 is a front perspective view of another example snow thrower.
Figure 30:
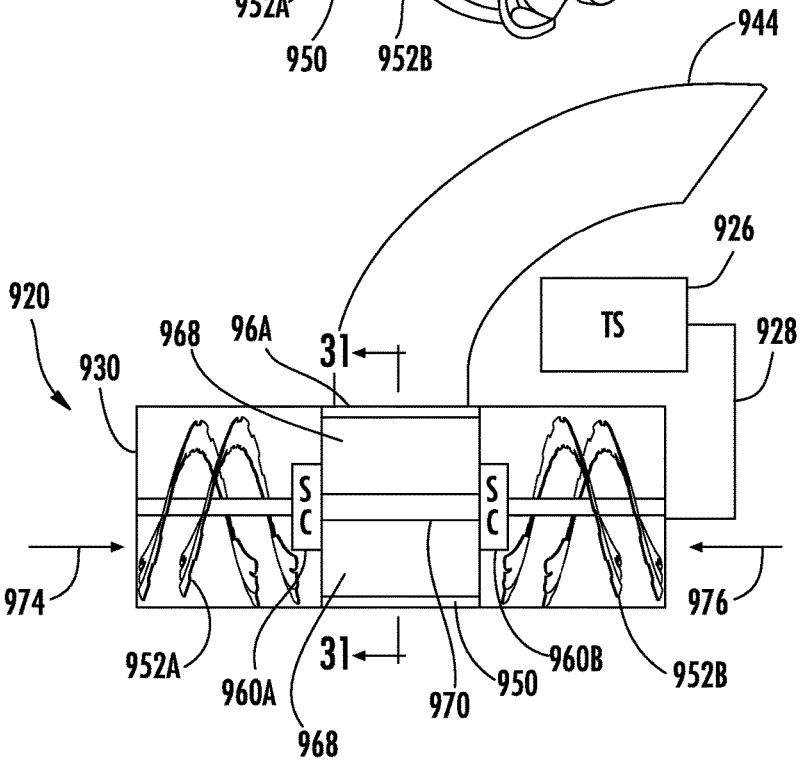
FIG. 30 is a front view of the snow thorough FIG. 29 with portions schematically shown.
Figure 31:
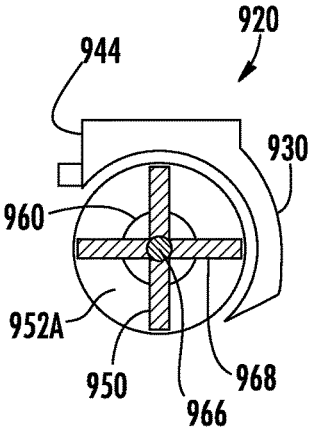
FIG. 31 is a sectional view of the snow thrower of FIG. 30 take along line 31-31.

FIGS. 29-31 illustrate an example of the hybrid snow thrower or snow blower 920. Snow thrower 920 comprises a hybrid between a single stage snow thrower and a two stage snow thrower. Snow thrower 920 comprises torque source 926, transmission 928, auger housing 930, chute 944, snow impelling blades 950, snow channeling or moving blades 952A, 952B (collectively referred to as blades 952) and speed changing devices 960A, 960B (collectively referred to as speed changing devices 960). Torque source 926 comprises a source of torque for rotationally driving blades 950 and 952. In one implementation, torque source 926 comprises an internal combustion engine. Another implementation, torque source 926 comprises a battery or electrically powered motor. Although torque source 926 has a single output which is used to drive both blades 950, 952, in other implementations, torque source 9206 may include two separate outputs with one output for blades 950 and another output for blades 952. In yet other implementations, snow thrower 920 may include separate torque sources for blades 950 and blades 952.

Transmission 928 transmits torque from torque source 926 to blades 950, 952 to rotationally drive blades 950,952 within auger housing 930. In one implementation, transmission 928 may comprise a series of gears. In another implementation, transmission 928 may comprise a chain and sprocket arrangement or a belt and pulley arrangement. In some implementations, transmission 928 may comprise a combination of such torque transmitting mechanisms. In the example illustrated, transmission 928 extends along a side or exterior of auger housing 930, wherein transmission 928 is connected to one drive shaft of one of blades 952 such that torque is transmitted first to one of blades 952 prior to being transmitted to plate 950. In other implementations, transmission 928 may centrally extend in a forward direction from torque source 926 to blades 950 so as to first transmit torque to blades 950 prior to transmitting torque to blades 952.

Auger housing 930 houses snow engaging blades 950, 952. Auger housing 130 directs snow to blades 950, 952. In one implementation, auger housing 930 comprises a single integral structure integrally formed as a single unitary body of a single sheet or layer of material that is deformed or deep drawn. In other implementations, auger housing 930 may be formed from multiple structures which are welded, fastened or otherwise joined to one another. In other implementations, auger housing 930 may include other features described above such as extensions 132.

Chute 944 comprises a tubular or semi-tubular structure extending from an opening 964 within auger housing 930. Chute 944 extends upward and outward to direct impel snow forwarder to a side of snow thrower 920. In one implementation, chute 944 may be similar to chute 44 described above.

Snow impelling blades 950 comprise blades, paddles or other structures configured to be rotationally driven about a rotational axis 966 (shown in FIG. 31) to drive snow upward through opening 964 and through chute 944 for discharge. In the example illustrated, snow impelling blades 950 comprise panels or paddles 968 radially extending outward from axis 966 and radially outward from drive shaft 970 with each panel 968 extending in a plane intersecting and parallel to axis 966. As a result, snow engaged by blade 968 is impelled upward and outward. In the example illustrated, blade 968 further includes outer portions configured to engage or come to close proximity with a ground so as to pick up snow. In one implementation, blades 968 include an outer elastomeric or flexible rubber-like outer extremity portion for engaging the ground. In other implementations, blades 968 may have other configurations.

Snow moving or snow engaging blades 952 (schematically shown) comprise blades rotatably supported within auger housing 930 and configured to engage the ground, to mulch snow and drive snow towards snow engaging blades 950. In the example illustrated, blades 952 comprise helical blades or helical augers for being rotatably driven about axis 966. In the example illustrated, blades 952A drive snow in a direction indicated by arrow 974 parallel to and along axis 966 towards blades 950. Blades 952B drive snow in a direction indicated by arrow 976 parallel to and along axis 968 towards blades 950. In the example illustrated, blades 952 are driven at a speed slower than a speed at which plates 950 are rotationally driven. Although blades 950, 952 are illustrated as being rotatable about a single axis 966, in other implementations, blades 950, 952 may be driven about distinct or different axes with respect to one another.

Speed changing devices 960 comprise devices configured to change or adjust a speed between an input torque and an output torque. Speech any device 960 are sometimes also referred to as speed adjusters, speed reducers and the like. Speed changing device 960 facilitates rotation of blades 952 at a lower speed as compared to the rotation of blades 950. As a result, snow thrower 920 utilizes less power, allowing a smaller torque source 9262 utilized. Said another way, speed changing device 960 facilitate rotation of those blades utilized to throw snow at a greater speed than the rotation of those blades which merely move snow in a substantially horizontal direction. Speed is provided where it is utilized most effectively, while low speed higher torque provided where it is utilized most effectively.

In one implementation, each of speed changing devices 960 comprises a planetary gear arrangement. In other implementations, each of speed changing devices 960 may have other configurations. In implementations where separate transmissions independently drive blades 950 with respect to blades 952, speed changes 960 may be omitted.

In operation, snow engaging blades 950 are rotationally driven within auger housing 930 opposite to chute 944 at a first be while snow engaging blades 952 are rotationally driven within auger housing 930 at a second speed less than the first beat. In the example illustrated, blades 9 5952 are driven about a single rotational axis. Blades 952 move snow towards blades 950. Blades 950 extend parallel to rotational axis 966 while blades 952 helically extend at least partially about their rotational axis (and about axis 966 in the example illustrated).

Although the claims of the present disclosure are generally directed to a three stage snow thrower, the present disclosure is additionally directed to the features set forth in the following definitions.

Vertical Shaft Engine

1. An apparatus comprising:
a vertical shaft engine;
an implement operably coupled to the vertical shaft engine and rotationally drivable about a horizontal axis;
traction members; and
a friction drive operably coupled to and between the vertical shaft engine and the traction the members.

2. A snow thrower comprising:
a vertical shaft engine;
traction members driven by the vertical shaft engine; and an auger driven by the vertical shaft engine.

3. The snow thrower of definition 2 further comprising a right angle gear drive operably coupled between the vertical shaft engine and the auger.

4. The snow thrower of definition 2 further comprising an impeller to receive snow from the auger.

5. A snow thrower comprising:
a vertical shaft engine;
an auger;
traction members rotatable about the traction axis by the vertical shaft engine; and
a friction drive rearward of the traction axis of the traction members.

6. The snow thrower of definition 5, wherein the friction drive is rearward a vertical shaft of the vertical shaft engine.

7. An apparatus comprising:
a vertical shaft engine;
traction members drivable by the vertical shaft engine; and
a friction drive comprising:
a friction wheel; and
a friction plate, wherein the friction plate is pivotable about a horizontal axis.

8. The apparatus of definition 7, wherein the friction plate extends below the friction wheel and is resiliently biased towards a raised position 9. The apparatus of definition 7, wherein gravity urges the friction plate away from the friction wheel 10. The apparatus of definition 7, wherein the friction drive is provided at least one of reward of the engine drive shaft and behind the traction members.

Sweeper

1. A snow thrower comprising:
a rotatable snow moving member for being rotatably driven about a first axis; and
a sweeper having flexible terrain engaging members, the sweeper being rotatably driven about a second axis lower than the first axis.

2. The snow thrower of definition 1 further comprising a drive to rotationally drive the snow moving member and the sweeper.

3. The snow thrower of definition 1 further comprising a scraper bar adjacent the sweeper rearward of the second axis.

4. The snow thrower of definition 1, wherein the sweeper comprises a brush.

5. The snow thrower of definition 4, wherein the brush comprises:
the first set of bristles having a first length and the first rigidity; and
a second set of bristles having a second length shorter than the first length and a second rigidity greater than the first rigidity.

6. The snow thrower of definition 1, wherein the sweeper comprises circumferentially spaced flexible paddles.

7. The snow thrower of definition 6, wherein the flexible paddles extend from the second axis.

8. The snow thrower of definition 1, wherein the sweeper is movable between a first position adjacent the terrain and a second position elevated above the terrain.

9. The snow thrower of definition 8, wherein the second axis is higher than the first axis within the second position.

10. The snow thrower of definition 10, wherein the sweeper is disconnected from a drive in the second position.

11. The snow thrower of definition 10, wherein the sweeper is operably connected to a drive of the snow thrower when in the first position so as to be rotatably driven in a first direction and is operably connected to the drive when in the second position so as to be rotatably driven in a second direction opposite to the first direction.

12. The snow thrower of definition 1, wherein the rotatable snow moving member is connected to a drive so as to be rotatably driven in a first direction and wherein the sweeper is connected to the drive so as to be rotatably driven in a second direction opposite to the first direction.

13. The snow thrower of definition 1, wherein the rotatable snow moving member is connected to a drive so as to be rotatably driven in a first direction and wherein the sweeper is connected to the drive so as to be rotatably driven in a second direction the same as the first direction.

14. The snow thrower of definition 1, wherein the sweeper is connected to a drive to be rotatably driven at a first velocity and wherein the rotatable snow moving member is connected to the drive to be rotatably driven at a second velocity less than the first velocity.

15. The snow thrower of definition 1 further comprising a skid movable from a raised position to a terrain engaging position in response to movement of the sweeper from the first position to the second position.

16. The snow thrower of definition 1, wherein the snow moving member is an auger.

17. The snow thrower of definition 1, wherein a portion of the weight of the snow thrower is supported by the sweeper Chute 1. A chute assembly for a snow thrower, the chute assembly comprising:

a lower chute having one of projections and detents; and an upper chute having the other of projections and detents, wherein at least one of the lower chute and the upper chute resiliently flex to permit projections to be snapped into the detents and wherein the projections and detents cooperate to permit pivoting of the upper chute relative to the lower chute.

2. The chute assembly of definition 1 wherein the upper chute telescopes with respect to the lower chute.

3. The chute assembly of definition 1, wherein the detents comprise a first slot and a second slot, wherein the projections comprising a first projection slidable within the first slot and a second projection slidable within the second slot and wherein the first projection is configured to slide upwards in the first slot while second projection slides downward in the second slot during pivoting of the upper chute.

4. The chute assembly of definition 1 wherein the upper chute is connected to the lower chute with a four-bar linkage.

Hybrid Snow Thrower

1. A snow thrower comprising:

an auger housing;

a chute extending from the auger housing;

a first snow engaging blade rotatably supported within the auger housing opposite the chute;

a second snow engaging blade rotatably supported within the auger housing on a first side of the first snow engaging blade, wherein the first snow engaging blade and the second snow engaging blade are rotatable at different speeds relative to one another.

2. The snow thrower of definition 1 further comprising a torque source, wherein both the first snow engaging blade and the second snow engaging blade are rotatably driven at different relative speeds using the torque source.

3. The snow thrower of definition 1 further comprising a speed change device between the first snow engaging blade and the second snow engaging blade.

4. The snow thrower of definition 1, wherein the first snow engaging blade is rotatably driven at a speed greater than the second snow engaging blade using a single torque source.

5. The snow thrower of definition 1 further comprising a third snow engaging blade rotatably supported within the housing on a second side of the first snow engaging blade, wherein the third snow engaging blade and the first snow engaging blade are rotatable at different relative speeds.

6. The snow thrower of definition 1, wherein the first snow engaging blade and the second snow engaging blade rotate about a rotational axis, wherein the first snow engaging blade extends substantially parallel to the rotational axis and wherein the second snow engaging blade helically extends about the rotational axis.

7. The snow thrower of definition 1 further comprising a speed changing device between the first snow engaging blade and the second snow engaging blade such that the first snow engaging blade rotates at a first velocity and such that the second snow engaging blade rotates at a second velocity less than the first velocity.

8. A method comprising:

rotationally driving a first snow engaging blade within an auger housing opposite to a chute at a first speed; and rotationally driving a second snow engaging blade within the auger housing at a second speed less than the first speed.

9. The method of definition 8, wherein the first snow engaging blade and the second snow engaging blade are driven about a single rotational axis.

10. The method of definition 8, wherein the second snow engaging blade moves snow towards the first snow engaging blade.

11. The method of definition 8, wherein the first snow engaging blade extend parallel to the rotational axis of the first snow engaging blade and wherein the second snow engaging blade helically extends at least partially about a rotational axis of the second snow engaging blade.

12. The method of definition 8 further comprising:

rotationally driving a third snow engaging blade within the auger housing at a third speed less than the first speed;

moving snow towards the first snow engaging blade in a first direction parallel to a rotational axis of the first snow engaging blade with the third snow engaging blade; and moving snow towards the first snow engaging blade in a second direction opposite to the first direction and parallel to the rotational axis of the first snow engaging blade with the second snow engaging blade.

13. The method of definition 8, wherein the first snow engaging blade and the second snow engaging blade are rotationally driven with a single torque source, employing a speed changing device between the first snow engaging blade and the second snow engaging blade.

Adjustable Auger Housing

1. A snow thrower comprising:

a rotatable snow moving member;

a housing about the rotatable snow moving member, the housing having a mouth defined by a bottom edge, a top edge, a first side edge and a second side edge;

a first side extension pivotally coupled to the first side edge for pivoting between a first position and a second position; and a retainer to retain the first side extension in the first position.

2. The snow thrower of definition 1 further comprising a powered actuator operably coupled to the first side extension to move the first side extension between the first position and the second position.

3. The snow thrower of definition 3, wherein the powered actuator comprises:

a motor;

a threaded shaft rotationally drivable by the motor; and a threaded member threadably mounted onto the shaft and operably coupled to the first side extension.

4. The snow thrower of definition 1, wherein the retainer comprises a threaded member rotatable between a retaining position retaining the first side extension against movement and a releasing positioned allowing the first side extension to be moved.

5. The snow thrower of definition 1 further comprising a second side extension pivotably coupled to the second side edge.

Housing Support Discs

1. A snow thrower comprising:

a housing;

a rotating snow moving member within the housing;

a first rotatable disc coupled to the housing having an outer circumference lower than a bottom of the housing.

2. The snow thrower of definition 1, wherein the first rotatable disc is adjustable to one of a plurality of available positions.

3. The snow thrower of definition 1, wherein the first disc has a thickness so as to cut through compacted snow.

4. The snow thrower of definition 3, wherein the first disc has a thickness of less than or equal to 0.5 inches.

5. The snow thrower of definition 1, wherein the first disc has circumferential edge sufficiently soft so as to not score underlying pavement.

6. The snow thrower of definition 1, wherein the first disc has a polymeric circumferential edge.

7. The snow thrower of definition 6, wherein the edge is formed from a high density polyethylene.

8. The snow thrower of definition 1 further comprising a second rotatable disc coupled to the housing having an outer circumference lower than the bottom of the housing.

9. The snow thrower of definition 8, wherein the second rotatable disc is adjustable to one of a plurality of available positions.

10. The snow thrower of definition 8, wherein the second disc has a thickness so as to cut through compacted snow.

11. The snow thrower of definition 10, wherein the second disc has a thickness of less than or equal to 0.5 inches.

12. The snow thrower of definition 8, wherein the second disc has circumferential edge sufficiently soft so as to not score underlying pavement.

13. The snow thrower of definition 8, wherein the second disc has a polymeric circumferential edge.

14. The snow thrower of definition 13, wherein the circumferential edge of the second disc is formed from a high density polyethylene.

15. The snow thrower of definition 18, wherein the first disc and the second disc extend outwardly beyond first and second opposite sides, respectively, of the housing.

16. The snow thrower of definition 1, wherein the housing comprise a skid shoe mounting structure and wherein the first disc is configured to mount to the housing using the skid shoe mounting structure.

17. The snow thrower of definition 1 further comprising a skid shoe having a skid surface and coupled to the housing adjacent the first disc, wherein the outer circumference of the first disc extends lower than the skid surface.

18. An accessory for a snow thrower, the accessory comprising:

a rotatable disc for being removably mounted to a housing of the snow thrower, the disc having an outer circumference configured to extend lower than a bottom of the housing when the disc is mounted to the housing.

19. The accessory of definition 18, wherein the first rotatable disc is adjustable to one of a plurality of available positions.

20. The accessory of definition 18, wherein the disc has a thickness so as to cut through compacted snow.

21. The accessory of definition 20, wherein the disc has a thickness of less than or equal to 0.5 inches.

22. The accessory of definition 18, wherein the disc has circumferential edge sufficiently soft so as to not score underlying pavement.

23. The accessory of definition 18, wherein the disc has a polymeric circumferential edge.

24. The accessory of definition 23, wherein the edge is formed from a high density polyethylene.

25. The accessory of definition 18, wherein the housing comprise a skid shoe mounting structure and wherein the disc is configured to mount to the housing using the skid shoe mounting structure.

26. The accessory of definition 18 further comprising a skid shoe having a skid surface, the skid shoe rotatably supporting the disc, wherein the outer circumference of the disc extends lower than the skid surface.

Compressed Gas Knife

1. A snow thrower comprising:

a housing;

the rotatable snow moving member at least partially within the housing; and a compressed gas knife coupled to the housing and aimed at an underlying terrain.

2. The snow thrower of definition 1 further comprising a source of compressed gas supplying compressed gas to the knife.

3. The snow thrower of definition 2, wherein the source has a user adjustable pressure for the compressed gas being supplied to the knife.

4. The snow thrower of definition 2, wherein the source supplies a pulsing compressed gas to the knife.

5. The snow thrower of definition 4, wherein the pulsed compressed gas is user adjustable between a plurality of non-zero pulsed settings.

6. The snow thrower of definition 2 further comprising a sensor, wherein the source supplies the compressed gas based on signals from the sensor.

7. The snow thrower of definition 6, wherein the compressed gas source is actuated between and on and an off state based on the sensor.

8. The snow thrower of definition 6, wherein the compressed gas source adjusts the pressure of the compressed gas based on the sensor.

9. The snow thrower of definition 6, wherein the compressed gas source adjusts a pulse of the compressed gas based on the sensor.

10. The snow thrower of definition 2, wherein the compressed gas source is configured to heat the compressed gas being supplied to the knife.

11. The snow thrower of definition 10 further comprising an engine, wherein the compressed gas source uses heat generated by the engine to heat the compressed gas.

12. The snow thrower of definition 2, wherein the compressed gas source is configured to inject an additive into a stream of compressed air.

13. The snow thrower of definition 12, wherein the additive comprises an alcohol.

14. The snow thrower of definition 12, wherein additive comprises a calcium chloride slurry, a liquid de-icer or a liquid snow-melter.

15. The snow thrower of definition 2, wherein the snow thrower comprises an engine and wherein the compressed gas source comprises a compressor powered by the engine.

16. The snow thrower of definition 1, wherein the rotatable snow moving member has an axial length and wherein the compressed gas knife extends along a majority of the axial length.

17. The snow thrower of definition 16, wherein compressed gas knife comprises a plurality of orifices spaced along the axial length.

18. The snow thrower of definition 16, wherein compressed gas knife comprises orifices extending at different angles towards the underlying terrain.

19. The snow thrower of definition 1, further comprising a scraper bar coupled to the housing along a bottom of the housing, wherein the compressed gas knife directs compressed gas forward of the scraper bar.

20. A snow thrower comprising a housing;
a rotatable snow moving member; and
a source of compressed air directed toward a bottom portion of the snow thrower.

21. The snow thrower of definition 20, wherein the compressed air is directed toward at least one of an area ahead of the rotatable snow moving member and an area behind the snow moving member.

22. The snow thrower of definition 20, wherein the compressed air is effective to remove snow that is not removable by the rotatable snow moving member.

23. The snow thrower of definition 22, wherein the snow that is not removable by the rotatable snow moving member is compressed snow.

Light

1. A snow thrower comprising:
a rotatable chute to direct snow being thrown; and
a first light source carried by the chute, wherein rotation of the chute aims light from the light source.

2. The snow thrower of definition 1, wherein the first light source faces in a first direction, the snow thrower further comprising a second light source carried by the chute and facing in a second direction perpendicular to the first direction such that when the chute is directing snow perpendicular to a direction of travel of the snow thrower, light is aimed both where the snow is being thrown and to where the housing is being moved.

3. The snow thrower of definition 1 further comprising:
a rotatable snow throwing member;
a housing about the rotatable snow throwing member, the housing having a mouth facing in a first direction and having a rim; and
a second light source carried by the rim of the housing and facing in the first direction.

4. The snow thrower of definition 4 further comprising a third light source carried along a side of the housing and facing in a direction perpendicular to the first direction.

5. A snow thrower comprising:
a rotatable snow throwing member;
a housing about the rotatable snow throwing member, the housing having a mouth facing in a first direction and having a rim; and
a first light source carried by the rim of the housing and facing in the first direction.

6. The snow thrower of definition 5 further comprising a third light source carried along a side of the housing and facing in a direction perpendicular to the first direction.

Snow Thrower Electronics

1. A snow thrower comprising:
an auger;
an impeller to receive snow from the auger;
a chute through which snow impelled by the impeller is discharged, the chute having an adjustable deflector to adjust a vertical angle at which snow is discharged; and
a powered actuator to move the adjustable deflector between a plurality of positions.

2. A snow thrower comprising:
an auger;
an impeller to receive snow from the auger;
a chute through which snow impelled by the impeller is discharged;
a drive to drive the impeller, wherein the drive is configured to adjust a speed of the impeller independent of a speed at which the auger is driven to adjust a throw distance.

3. The snow thrower of definition 3 further comprising a display to display an indication of a throw distance for snow being impelled by the impeller.

4. A snow thrower comprising:
an auger;
an impeller to receive snow from the auger;
a chute through which snow impelled by the impeller is discharged;
a battery;
an engine operably coupled to the auger and the impeller to drive the auger and the impeller;
a controller configured to set a choke, prime and turn over the engine in response to a manually actuated control input.

5. A snow thrower comprising:
an auger;
an impeller to receive snow from the auger;
a chute through which snow impelled by the impeller is discharged;
an engine;
a transmission operably coupling the engine to the auger and the impeller to drive the auger and the impeller;
an actuator operably coupled to at least one of the engine and the transmission to deliver power to the auger and the impeller;
a handle pivotable between a plurality of positions, the handle carrying a manual input; and
an electrical signal transmitting line extending from the manual input to the actuator, wherein the actuator adjusts output of the engine and/or transmission in response to electrical control signals received through the electrical transmitting line and generate in response to input to the manual input.

6. The snow thrower of definition 5, wherein the handle pivots about at least two horizontal axes between the plurality of positions to adjust the height of the handle without changing an angular orientation of the handle.

7. A snow thrower comprising:
an auger;
an impeller to receive snow from the auger;
a chute through which snow impelled by the impeller is discharged;
traction members for moving the snow thrower;
an engine-motor mechanism to drive the traction members;
a drive to drive the impeller, wherein the drive is configured to adjust a speed of the impeller independent of a speed at which the traction members are driven to adjust a throw distance.

8. The snow thrower of definition 7 further comprising a display to display an indication of a throw distance for snow being impelled by the impeller.

9. A snow thrower comprising:
an auger;
an impeller to receive snow from the auger;
a chute through which snow impelled by the impeller is discharged;
a rechargeable battery;
an engine operably coupled to the auger and the impeller to drive the auger and the impeller; and
a recoil charger cord carried by the snow thrower and electrically connected to the rechargeable battery.

Although the present disclosure has been described with reference to example embodiments, workers skilled in the art will recognize that changes may be made in form and detail without departing from the spirit and scope of the defined subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A snow thrower comprising:
a housing;
a rotatable snow moving member at least partially within the housing;
a compressed gas knife coupled to the housing and aimed at an underlying terrain forward the housing, wherein the rotatable snow moving member has an axial length, wherein the compressed gas knife extends along a majority of the axial length and wherein compressed gas knife comprises orifices extending at different angles towards the underlying terrain;
a source of compressed gas supplying compressed gas to the knife; and
a sensor to sense a characteristic of pack snow forward the housing, wherein the source supplies the compressed gas based on signals from the sensor.

2. The snow thrower of claim 1, wherein the source has a user adjustable pressure for the compressed gas being supplied to the knife.

3. The snow thrower of claim 1, wherein the source supplies a pulsing compressed gas to the knife.

4. The snow thrower of claim 3, wherein the pulsed compressed gas is user adjustable between a plurality of non-zero pulsed settings.

5. The snow thrower of claim 1, wherein the compressed gas source is actuated between and on and an off state based on the sensor.

6. The snow thrower of claim 1, wherein the compressed gas source adjusts the pressure of the compressed gas based on the sensor.

7. The snow thrower of claim 1, wherein the compressed gas source adjusts a pulse of the compressed gas based on the sensor.

8. The snow thrower of claim 1, wherein the compressed gas source is configured to heat the compressed gas being supplied to the knife.

9. The snow thrower of claim 8 further comprising an engine, wherein the compressed gas source uses heat generated by the engine to heat the compressed gas.

10. The snow thrower of claim 1, wherein the compressed gas source is configured to inject an additive into a stream of compressed air.

11. The snow thrower of claim 10, wherein the additive comprises an alcohol.

12. The snow thrower of claim 10, wherein additive comprises a calcium chloride slurry, a liquid de-icer or a liquid snow-melter.

13. The snow thrower of claim 1, wherein the snow thrower comprises an engine and wherein the compressed gas source comprises a compressor powered by the engine.

14. The snow thrower of claim 1, further comprising a scraper bar coupled to the housing along a bottom of the housing, wherein the compressed gas knife directs compressed gas forward of the scraper bar.

15. A snow thrower comprising:
a housing;
a rotatable snow moving member at least partially within the housing;
a compressed gas knife coupled to the housing and aimed at an underlying terrain forward the housing;
a source of compressed gas supplying compressed gas to the knife; and
a sensor, wherein the source supplies the compressed gas based on signals from the sensor, wherein the sensor is to sense a characteristic of pack snow forward the housing.

16. The snow thrower of claim 15, wherein the compressed gas source is actuated between and on and an off state based on the sensor.

17. The snow thrower of claim 15, wherein the compressed gas source adjusts the pressure of the compressed gas based on the sensor.

18. The snow thrower of claim 15, wherein the compressed gas source adjusts a pulse of the compressed gas based on the sensor.

19. The snow thrower of claim 15, wherein the sensor to sense a characteristic of pack snow.

* * * * *